US012402666B2

(12) United States Patent
Shim et al.

(10) Patent No.: US 12,402,666 B2
(45) Date of Patent: Sep. 2, 2025

(54) BLANK FORMED OF FABRIC FOR MANUFACTURING NO-SHOW SOCKS, NO-SHOW SOCKS FORMED OF BLANK AND MANUFACTURING METHOD OF NO-SHOW SOCKS

(71) Applicant: ONDO, Inc., New York, NY (US)

(72) Inventors: Tonghyun Shim, New York, NY (US); Donghwan Kim, Seoul (KR)

(73) Assignee: ONDO, Inc., New York, NY (US)

( * ) Notice: Subject to any disclaimer, the term of this patent is extended or adjusted under 35 U.S.C. 154(b) by 0 days.

(21) Appl. No.: 18/628,809

(22) Filed: Apr. 8, 2024

(65) Prior Publication Data

US 2024/0251883 A1 Aug. 1, 2024

Related U.S. Application Data

(63) Continuation of application No. 17/844,495, filed on Jun. 20, 2022, now Pat. No. 12,082,625.

(51) Int. Cl.
*A41B 11/10* (2006.01)

(52) U.S. Cl.
CPC ..... *A41B 11/10* (2013.01)

(58) Field of Classification Search
CPC ..... A41B 11/10; A41B 11/00; A41B 11/01; A43B 3/10; A43B 3/101; A43B 3/106; A43B 23/025
See application file for complete search history.

(56) References Cited

U.S. PATENT DOCUMENTS 1,009,772 A * 11/1911 Merrick ..... A43B 3/106 36/9 A
1,494,253 A * 5/1924 Karrer ..... A43B 3/106 36/11.5
2,210,475 A * 8/1940 Trimble ..... A43B 3/106 36/9 A
2,276,582 A * 3/1942 Krevis ..... A43B 3/106 36/9 A (Continued)

FOREIGN PATENT DOCUMENTS

GB 1240452 A 7/1971
KR 101020317 B1 3/2011

(Continued)

OTHER PUBLICATIONS

Office Action for the U.S. Appl. No. 17/844,495 issued by the USPTO on Jan. 22, 2024.

*Primary Examiner* — Heather Mangine
(74) *Attorney, Agent, or Firm* — IP & T GROUP LLP

(57) ABSTRACT

Disclosed is a no-show sock manufactured by using a fabric, the no-show sock including a bottom portion 10 configured to define a bottom of the no-show sock made by a series of fabrics connected integrally, a front portion 12 configured to cover toes and a front foot top, and first and second lateral portions 14 and 16 configured to surround lateral foot sides and a heel, in which the front portion 12 is connected to an upper end of the bottom portion 10, and a boundary line BL on which the bottom portion 10 and the front portion 12 are connected has a predetermined inclination angle θ with respect to a horizontal line HL perpendicular to a central axis CL of the bottom portion 10.

5 Claims, 20 Drawing Sheets

(56) References Cited

U.S. PATENT DOCUMENTS 2,376,398 A * 5/1945 Steffanson ..... A43B 23/28 36/68
2,391,165 A * 12/1945 Kasket ..... A41B 11/10 36/10
2,611,977 A * 9/1952 Yamada ..... A43B 3/106 36/11.5
2,714,771 A * 8/1955 Olfene ..... A41B 11/00 428/212
2,724,195 A * 11/1955 Luchs ..... A43B 23/28 36/10
3,143,870 A * 8/1964 Smith ..... D04B 1/108 66/178 R
3,217,336 A * 11/1965 Wikler ..... D04B 9/56 66/172 R
4,150,498 A * 4/1979 Palmer ..... A43B 23/042 2/61
4,550,446 A * 11/1985 Herman ..... A43B 23/042 2/239
4,599,811 A * 7/1986 Rousseau ..... A43B 3/26 36/97
5,020,164 A * 6/1991 Edwards ..... A41B 11/00 2/239
5,450,630 A * 9/1995 Hale ..... A41B 11/00 2/409
6,000,247 A * 12/1999 Takeda ..... D04B 15/14 66/187
6,044,497 A * 4/2000 Richardson ..... A41B 11/10 36/7.4
6,457,332 B1 * 10/2002 Schiavello ..... A41B 11/10 66/8
6,766,539 B1 * 7/2004 Huber ..... A41B 11/10 2/DIG. 1
7,849,609 B2 * 12/2010 Edington ..... A43B 23/042 36/55
10,993,499 B2 * 5/2021 Stirling ..... A43D 8/26
2003/0056395 A1 * 3/2003 Berggren ..... A43B 1/0081 36/15
2004/0143886 A1 * 7/2004 Lee ..... A41B 11/10 2/239
2004/0261466 A1 * 12/2004 Takeda ..... D04B 1/108 66/176
2010/0037370 A1 * 2/2010 Busi ..... D04B 1/108 112/475.12
2016/0219941 A1 * 8/2016 Hara ..... A41B 11/008
2018/0303179 A1 * 10/2018 Konukoglu ..... A61F 13/08
2020/0260802 A1 * 8/2020 Van Tiel ..... A41B 11/126
2023/0404173 A1 * 12/2023 Shim ..... A41B 11/10

FOREIGN PATENT DOCUMENTS

KR 20120041853 A 5/2012
KR 101178028 B1 8/2012
KR 101299590 B1 8/2013
KR 20150044321 A 4/2015
KR 200478268 Y1 9/2015
KR 101632988 B1 6/2016
WO 2021193888 A1 9/2021

* cited by examiner

BLANK FORMED OF FABRIC FOR MANUFACTURING NO-SHOW SOCKS, NO-SHOW SOCKS FORMED OF BLANK AND MANUFACTURING METHOD OF NO-SHOW SOCKS

CROSS-REFERENCE TO RELATED APPLICATION

This application is a continuation of U.S. patent application Ser. No. 17/844,495 filed on Jun. 20, 2022. The disclosures of which are incorporated herein by reference in their entirety.

TECHNICAL FIELD

The present invention relates to a blank for manufacturing no-show using a fabric, no-show socks manufactured by the blank, and a method of manufacturing no-show socks by using the blank.

DESCRIPTION OF THE RELATED ART

In general, socks are garments worn on the feet and made with various woven fabrics in order to protect the feet, be moisture wicking and increase breathability.

There are various types of socks such as crew socks having a length to a lower part of the calf, knee socks, ankle socks, no-show socks, and toe socks that are classified depending on shapes or lengths thereof.

Recently, due to change in popular styles in fashion and/or convenience, various types of socks such as ankle socks and no-show socks have become widely worn. In particular, many consumers purchase no-show socks because these no-show socks are not visible at all when worn with shoes. No-show socks are also called 'fake socks'.

Typically, socks are manufactured by sock knitting machines. In the sock knitting machine, needles are installed on a needle cylinder, and the needle cylinder on which the needles are installed rotates, such that the needles sequentially move upward or downward along lace grooves, thereby manufacturing the socks having a cylindrical shape. The above-mentioned sock knitting machine in the related art is configured to weave a bent portion, a neck portion, a heel portion, a foot top portion, a bottom portion, and a front portion of each of the crew socks into a cylindrical one-piece. However, according to the disclosure of Korean Patent No. 10-1178028, no-show socks have no neck portion and is opened at a foot top side thereof, unlike crew socks, and thus it is not easy to weave the no-show socks by using the sock knitting machine configured as described above. For this reason, the no-show socks are often manufactured by sewing raw woven fabrics.

However, as illustrated in FIG. 1, the above-mentioned method of manufacturing no-show socks in the related art is used to sew and connect a bottom portion, a cover portion, a lateral cover portion, a heel portion, and the like that constitute the no-show socks. Therefore, a fabric needs to be cut in accordance with divided component parts of the no-show socks, and the component parts corresponding to fabric pieces need to be sewn. For this reason, the manufacturing process is complicated, and the fabric pieces corresponding to the component parts are mixed during a manufacturing process, which results in lower productivity.

To solve the problem, Korean Utility Model Registration No. 20-0478268 discloses a no-show sock 500 that can be simply manufactured by using one piece of fabric, bending a tiptoe portion 520 and a heel portion 530 relative to a bottom portion 510, and then sewing the fabric, as illustrated in FIG. 2, thereby reducing labor costs or manufacturing costs.

In addition, Korean Patent No. 10-1632988 discloses non-sewn no-show socks 600 manufactured by using one piece of fabric. As illustrated in FIG. 4, the non-sewn no-show socks 600 disclosed in Korean Patent No. 10-1632988 includes: a bottom portion 610 including a bottom surface 611 having a shape similar to a shape of a sole and a lateral cover means 612 extending from two opposite surfaces of the bottom surface and configured to surround a part of a lateral surface of the foot; and a cover portion 620 configured as a front cover means extending from a front surface of the bottom portion 610 and having a width that may cover a part of a foot top including the toes. In addition, two opposite edges of the cover portion 620 are bonded to two opposite edges of an upper side of the lateral cover means 612 by means of a hot melt layer, and lower end edges 612*a* and 612*b* of the lateral cover means 612 are bonded to each other by means of a hot melt layer.

However, as illustrated in FIGS. 6A and 6B, among the human toes, the big toe and/or the second toe generally has a longer shape than the remaining toes (the third toe, the fourth toe, etc.). However, as illustrated in FIG. 3 or 5, a front side of a toe portion of the no-show sock in the related art has a straight shape in accordance with the big toe portion and/or the second toe portion. For this reason, when a user wears no-show socks, the big toe portion and/or the second toe portion are/is somewhat tightly fitted with the user's foot, whereas the little toe portion is loosened and has gaps. For this reason, the shape of the foot of the user wearing the no-show sock is not fashionable, and the wearing comfort is also degraded. In addition, the portion of the no-show sock in the related art, which is expanded by the big toe or the second toe because of friction between the no-show socks and the shoe, is relatively easily damaged, and the durability of the socks decreases. For this reason, no-show socks disclosed in the prior arts are difficult to manufacture and have durability concerns.

DISCLOSURE

Technical Problem

The present invention has been made in an effort to solve the technical problems in the prior art, and an embodiment of the present invention is to provide a blank for manufacturing no-show socks using a fabric, so that the toe portions of the no-show socks may approximately correspond to an extension line on the tip of the toe area, no-show socks manufactured by the blank, and a method of manufacturing no-show socks by using the blank.

Technical Solution

According to one aspect of the present invention, a blank for manufacturing a no-show sock by using a fabric according to a first embodiment includes: a bottom portion configured to define a bottom of the no-show sock made by a series of fabrics connected integrally; a front portion configured to cover toes and a front foot top; and first and second lateral portions configured to surround lateral foot sides and a heel, in which the front portion is connected to an upper end of the bottom portion, and in which a boundary line on which the bottom portion and the front portion are connected has a predetermined inclination angle with respect to a horizontal line perpendicular to a central axis of the bottom portion. In this case, the inclination angle may be about 5° to 30°.

In the blank for manufacturing a no-show sock by using a fabric according to the first embodiment, the bottom portion may have a contour corresponding to a sole, first and second lateral portions may be connected to two opposite surfaces of a lower side of the bottom portion, respectively, a lower end of the bottom portion may have a contour curved and protruding outward to correspond to the heel, a ninth superimposed portion may be formed at a lower end of the bottom portion, a third superimposed portion may be formed at an upper end of the first lateral portion, a first cutting line extending to a lower end of the third superimposed portion may be formed inside the third superimposed portion, a fifth superimposed portion may be formed at a lower end of the first lateral portion, a seventh superimposed portion may be positioned inside the first lateral portion, a fourth superimposed portion may be formed at an upper end of the second lateral portion, a second cutting line extending to a lower end of the fourth superimposed portion may be formed inside the fourth superimposed portion, a sixth superimposed portion may be formed at a lower end of the second lateral portion, an eighth superimposed portion may be formed inside the second lateral portion, first and second superimposed portions may be formed at two opposite sides of an upper end of the front portion, two opposite edges of the front portion may have contours corresponding to two opposite edges of the bottom portion, and when the front portion is folded along the boundary line relative to the bottom portion, rear surfaces of the first and second superimposed portions at the upper end of the front portion may be arranged to overlap a front surface of the third superimposed portion at the upper end of the first lateral portion and a front surface of the fourth superimposed portion at the upper end of the second lateral portion, respectively and sewn together at upper and lower ends of an overlapping portion, and the two opposite edges of the front portion may be aligned to correspond to the two opposite edges of the upper side of the bottom portion, respectively and sewn together, the fifth superimposed portion at the lower end of the first lateral portion and the sixth superimposed portion at the lower end of the second lateral portion may overlap each other and be sewn together, and the ninth superimposed portion at the lower end of the bottom portion may overlap with the seventh superimposed portion inside the first lateral portion and the eighth superimposed portion inside the second lateral portion and be sewn together with them.

In addition, in the blank for manufacturing a no-show sock according to the first embodiment of the present invention, a protrusion protruding outward along a centerline of the bottom portion may be formed at a center of the ninth superimposed portion at the lower end of the bottom portion.

In addition, the blank for manufacturing a no-show sock according to the first embodiment of the present invention may be made by a fabric made by crossing and weaving a weft and a warp having elasticity.

According to another aspect of the present invention, a no-show sock manufactured by using a fabric according to the first embodiment includes: a bottom portion configured to define a bottom made by a series of fabrics connected integrally; a front portion configured to cover toes and a front foot top; and first and second lateral portions configured to surround lateral foot sides and a heel, in which the front portion is connected to an upper end of the bottom portion, and in which a boundary line on which the bottom portion and the front portion are connected has a predetermined inclination angle with respect to a horizontal line perpendicular to a central axis of the bottom portion. In this case, the inclination angle may be about 5° to 30°.

In the no-show sock manufactured by using a fabric according to the first embodiment, the bottom portion may have a contour corresponding to a sole, first and second lateral portions may be connected to two opposite surfaces of a lower side of the bottom portion, respectively, a lower end of the bottom portion may have a contour curved and protruding outward to correspond to the heel, a ninth superimposed portion may be formed at a lower end of the bottom portion, a third superimposed portion may be formed at an upper end of the first lateral portion, a first cutting line extending to a lower end of the third superimposed portion may be formed inside the third superimposed portion, a fifth superimposed portion may be formed at a lower end of the first lateral portion, a seventh superimposed portion may be positioned inside the first lateral portion, a fourth superimposed portion may be formed at an upper end of the second lateral portion, a second cutting line extending to a lower end of the fourth superimposed portion may be formed inside the fourth superimposed portion, a sixth superimposed portion may be formed at a lower end of the second lateral portion, an eighth superimposed portion may be formed inside the second lateral portion, first and second superimposed portions may be formed at two opposite sides of an upper end of the front portion, two opposite edges of the front portion may have contours corresponding to two opposite edges of the bottom portion, and when the front portion is folded along the boundary line relative to the bottom portion, rear surfaces of the first and second superimposed portions at the upper end of the front portion may be arranged to overlap a front surface of the third superimposed portion at the upper end of the first lateral portion and a front surface of the fourth superimposed portion at the upper end of the second lateral portion, respectively and sewn together at upper and lower ends of an overlapping portion, and the two opposite edges of the front portion may be aligned to correspond to the two opposite edges of the upper side of the bottom portion, respectively and sewn together, the fifth superimposed portion at the lower end of the first lateral portion and the sixth superimposed portion at the lower end of the second lateral portion may overlap each other and be sewn together, and the ninth superimposed portion at the lower end of the bottom portion may overlap with the seventh superimposed portion inside the first lateral portion and the eighth superimposed portion inside the second lateral portion and be sewn together with them.

In addition, the no-show sock according to the first embodiment of the present invention may be made by a fabric made by crossing and weaving a weft and a warp having elasticity.

In addition, in the no-show sock according to the first embodiment of the present invention, a reinforcing fabric may be attached along the boundary line between the bottom portion and the front portion. Further, an expansion/contraction ratio of a fiber arranged in a vertical direction may be larger than an expansion/contraction ratio of a fiber arranged in a horizontal direction in the reinforcing fabric.

In addition, in the no-show sock according to the first embodiment of the present invention, elastic bands may be attached to an edge of the upper end of the front portion, an edge of the first lateral portion, and an edge of the second lateral portion, respectively.

In addition, in the no-show sock according to the first embodiment of the present invention, a bonding agent may be applied between a rear surface of the first superimposed portion of the front portion and a front surface of the third superimposed portion of the first lateral portion and between a rear surface of the second superimposed portion of the front portion and a front surface of the fourth superimposed portion of the second lateral portion.

In addition, in the no-show sock according to the first embodiment of the present invention, a silicone friction member may be attached to an outer portion of an overlapping portion between the fifth superimposed portion of the first lateral portion and the sixth superimposed portion of the second lateral portion. Further, a silicone friction member may be attached to portions of the edges of the first and second lateral portions that correspond to the heel.

According to another aspect of the present invention, a method of manufacturing a no-show sock by using a fabric according to the first embodiment includes: cutting a fabric including a bottom portion configured to define a bottom made by a series of fabrics connected integrally, a front portion configured to cover toes and a front foot top, and first and second lateral portions configured to surround lateral foot sides and a heel, in which the front portion is connected to an upper end of the bottom portion, and a boundary line on which the bottom portion and the front portion are connected has a predetermined inclination angle with respect to a horizontal line perpendicular to a central axis of the bottom portion; folding the front portion along the boundary line relative to the bottom portion; aligning an outer end of a first superimposed portion of the front portion with a first cutting line of the first lateral portion so that a rear surface of the first superimposed portion of the front portion overlaps a front surface of a third superimposed portion of the first lateral portion, and aligning an outer end of a second superimposed portion of the front portion with a second cutting line of the second lateral portion so that a rear surface of the second superimposed portion of the front portion overlaps a front surface of a fourth superimposed portion of the second lateral portion; sewing the first superimposed portion of the front portion and the third superimposed portion of the first lateral portion in one or more lines, sewing the second superimposed portion of the front portion and the fourth superimposed portion of the second lateral portion in one or more lines, and sewing two opposite edges of the front portion and two opposite edges of an upper side of the bottom portion in one or more lines; superimposing a fifth superimposed portion at a lower end of the first lateral portion and a sixth superimposed portion at a lower end of the second lateral portion and sewing them in one or more lines; and superimposing a ninth superimposed portion at a lower end of the bottom portion, a seventh superimposed portion inside the first lateral portion, and an eighth superimposed portion inside the second lateral portion and sewing them in one or more lines. In this case, the inclination angle may be about 5° to 30°.

According to another aspect of the present invention, a blank for manufacturing a no-show sock by using a fabric according to a second embodiment of the present invention includes: a bottom portion made by a series of fabrics connected integrally, having a contour corresponding to a sole, and configured to define a bottom of the no-show sock; a front portion having a contour corresponding to toes and a front foot top; and first and second lateral portions configured to surround lateral foot sides and a heel, in which the front portion is connected to an upper end of the bottom portion, and in which a boundary line on which the bottom portion and the front portion are connected has a predetermined inclination angle with respect to a horizontal line perpendicular to a central axis of the bottom portion. In this case, the inclination angle may be about 5° to 30°.

In the blank for manufacturing a no-show sock by using a fabric according to the second embodiment of the present invention, first and second lateral portions may be connected to two opposite surfaces of the bottom portion, respectively, a lower end of the bottom portion may have a contour curved and protruding outward to correspond to the heel, a ninth superimposed portion may be formed at a lower end of the bottom portion, a fifth superimposed portion may be formed at a lower end of the first lateral portion, a seventh superimposed portion may be formed inside the first lateral portion, a sixth superimposed portion may be formed at a lower end of the second lateral portion, an eighth superimposed portion may be formed inside the second lateral portion, two opposite edges of the front portion may have contours corresponding to an upper edge of the first lateral portion and an upper edge of the second lateral portion, respectively, and when the front portion is folded along the boundary line relative to the bottom portion, the two opposite edges of the front portion may be aligned and coincident with the upper edge of the first lateral portion and the upper edge of the second lateral portion, respectively and seam-sealed together, the fifth superimposed portion at the lower end of the first lateral portion and the sixth superimposed portion at the lower end of the second lateral portion may overlap each other and be sewn together, and the ninth superimposed portion at the lower end of the bottom portion may overlap with the seventh superimposed portion inside the first lateral portion and the eighth superimposed portion inside the second lateral portion and be sewn together with them.

In addition, in the blank for manufacturing a no-show sock by using a fabric according to the second embodiment of the present invention, a protrusion protruding outward along a centerline of the bottom portion may be formed at a center of the ninth superimposed portion at the lower end of the bottom portion.

According to another aspect of the present invention, a no-show sock manufactured by using a fabric according to the second embodiment includes: a bottom portion made by a series of fabrics connected integrally, having a contour corresponding to a sole, and configured to define a bottom of the no-show sock; a front portion having a contour corresponding to toes and a front foot top; and first and second lateral portions configured to surround lateral foot sides and a heel, in which the front portion is connected to an upper end of the bottom portion, in which a boundary line on which the bottom portion and the front portion are connected has a predetermined inclination angle with respect to a horizontal line perpendicular to a central axis of the bottom portion, in which the first and second lateral portions are respectively connected to two opposite surfaces of the bottom portion, a lower end of the bottom portion has a contour curved and protruding outward to correspond to the heel, and a ninth superimposed portion is formed at a lower end of the bottom portion, in which a fifth superimposed portion is formed at a lower end of the first lateral portion, and a seventh superimposed portion is formed inside the first lateral portion, in which a sixth superimposed portion is formed at a lower end of the second lateral portion, and an eighth superimposed portion is formed inside the second lateral portion, in which two opposite edges of the front portion have contours corresponding to an upper edge of the first lateral portion and an upper edge of the second lateral portion, respectively, in which when the front portion is folded along the boundary line relative to the bottom portion, the two opposite edges of the front portion are aligned and coincident with the upper edge of the first lateral portion and the upper edge of the second lateral portion, respectively and seam-sealed together, in which the fifth superimposed portion at the lower end of the first lateral portion and the sixth superimposed portion at the lower end of the second lateral portion overlap each other and are sewn together, and in which the ninth superimposed portion at the lower end of the bottom portion may overlap with the seventh superimposed portion inside the first lateral portion and the eighth superimposed portion inside the second lateral portion and be sewn together with them. In this case, the inclination angle of the boundary line, on which the bottom portion and the front portion are connected, with respect to the horizontal line perpendicular to the central axis of the bottom portion may be about 5° to 30°.

In the no-show socks according to the second embodiment of the present invention, the bottom portion, the front portion, and the first and second lateral portions may be made by a fabric made by crossing and weaving the weft and the warp having elasticity.

In addition, in the no-show sock according to the second embodiment of the present invention, a reinforcing fabric may be attached along the boundary line between the bottom portion and the front portion. Further, an expansion/contraction ratio of a fiber arranged in a vertical direction may be larger than an expansion/contraction ratio of a fiber arranged in a horizontal direction in the reinforcing fabric.

In addition, in the no-show sock according to the second embodiment of the present invention, elastic bands may be attached to an edge of the upper end of the front portion, an edge of a lower side of the first lateral portion, and an edge of a lower side of the second lateral portion, respectively.

In addition, in the no-show sock according to the second embodiment of the present invention, a silicone friction member may be attached to an outer portion of an overlapping portion between the fifth superimposed portion of the first lateral portion and the sixth superimposed portion of the second lateral portion. Further, a silicone friction member may be attached to portions of the edges of the first and second lateral portions that correspond to the heel.

According to another aspect of the present invention, a method of manufacturing a no-show sock by using a fabric according to the second embodiment includes: cutting a fabric including a bottom portion made by a series of fabrics connected integrally, having a contour corresponding to a sole, and configured to define a bottom of the no-show sock, a front portion configured to cover toes and a front foot top, and first and second lateral portions configured to surround lateral foot sides and a heel, in which the front portion is connected to an upper end of the bottom portion, and a boundary line on which the bottom portion and the front portion are connected has a predetermined inclination angle with respect to a horizontal line perpendicular to a central axis of the bottom portion; folding the front portion along the boundary line relative to the bottom portion; aligning two opposite edges of the front portion with an upper edge of the first lateral portion and an upper edge of the second lateral portion so that the two opposite edges of the front portion are coincident with the upper edge of the first lateral portion and the upper edge of the second lateral portion, and seam sealing the two opposite edges of the front portion together; superimposing a fifth superimposed portion at a lower end of the first lateral portion and a sixth superimposed portion at a lower end of the second lateral portion and sewing them in one or more lines; and superimposing a ninth superimposed portion at a lower end of the bottom portion, a seventh superimposed portion inside the first lateral portion, and an eighth superimposed portion inside the second lateral portion and sewing them in one or more lines. In this case, the inclination angle may be about 5° to 30°.

Advantageous Effects

According to the blank for manufacturing the no-show sock by using the fabric, the no-show sock manufactured by the blank, and the method of manufacturing the no-show sock in accordance with the present invention, the toe portions of the no-show sock may approximately correspond to the extension line on the tip of the toe area, such that the shape of the foot of the user wearing the no-show sock may be fashionable, and the no-show socks fits more comfortably to the user. In addition, it is possible to solve the problem that the portion of the no-show socks, which come into contact with the big toe and/or the second toe, is excessively expanded compared to the other portions, thereby improving the durability of the no-show socks.

DETAILED DESCRIPTION OF THE DISCLOSURE

Figure 1:
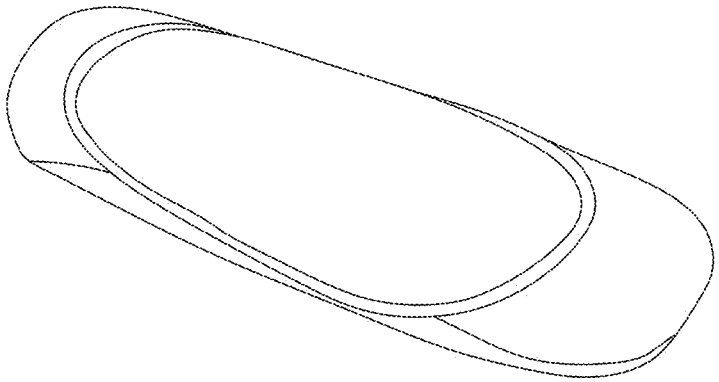
FIG. 1 (Prior Art)
FIG. 1 is a view schematically illustrating a no-show sock in the related art.
Figure 2:
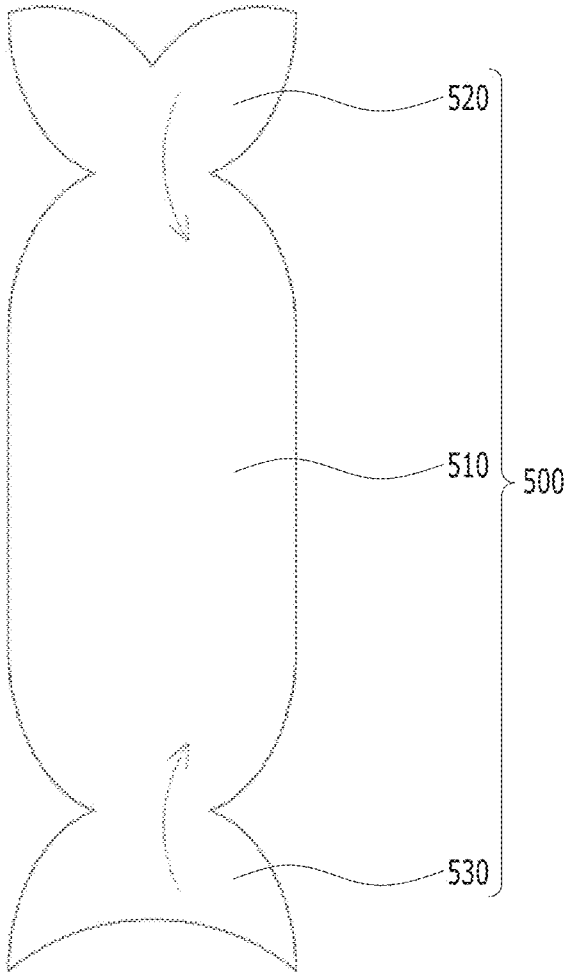
FIG. 2 (Prior Art)
FIG. 2 is a development view of a no-show sock in the related art.
Figure 3:
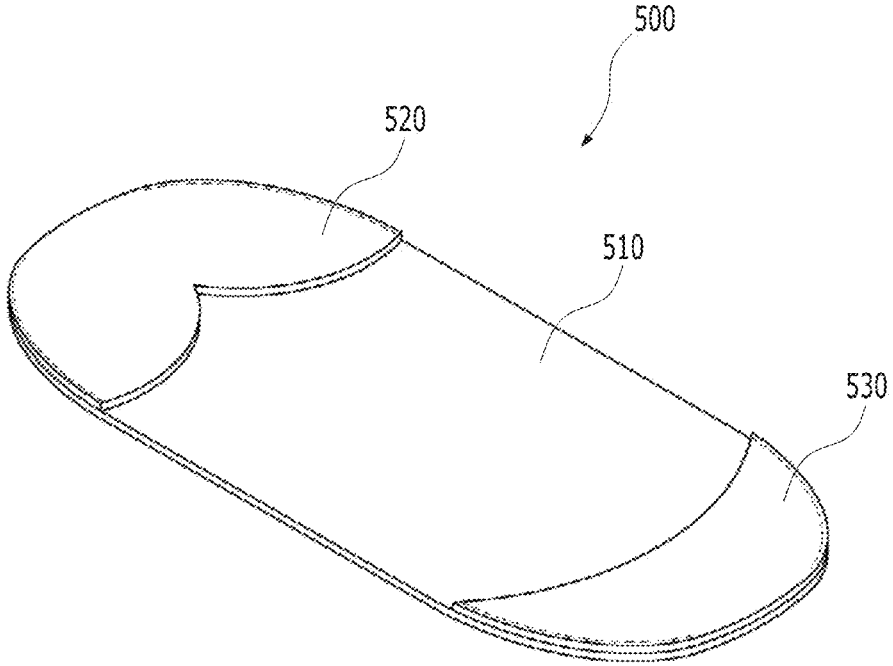
FIG. 3 (Prior Art)
FIG. 3 is a view schematically illustrating the no-show sock manufactured in accordance with the development view of FIG. 2.
Figure 4:
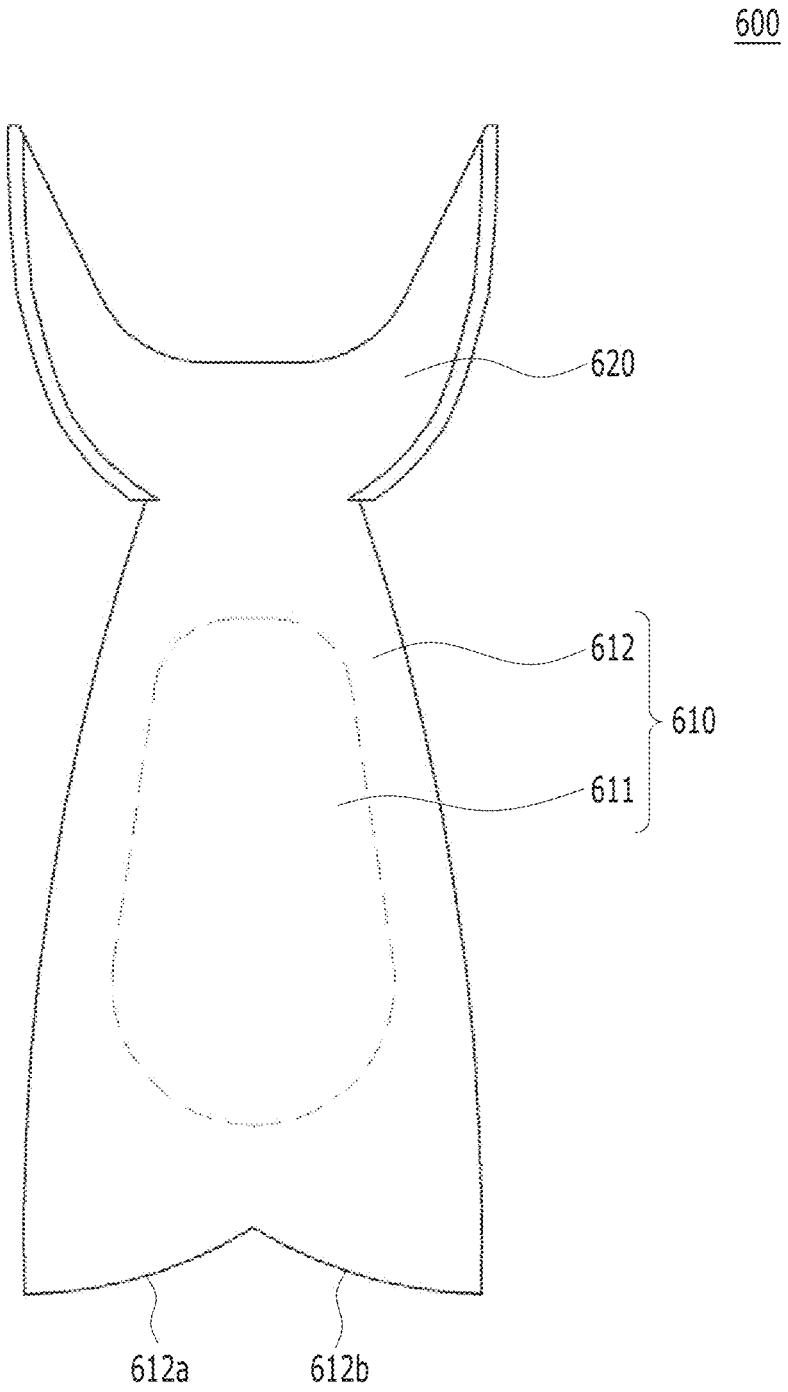
FIG. 4 (Prior Art)
FIG. 4 is a development view of another no-show sock in the related art.
Figure 5:
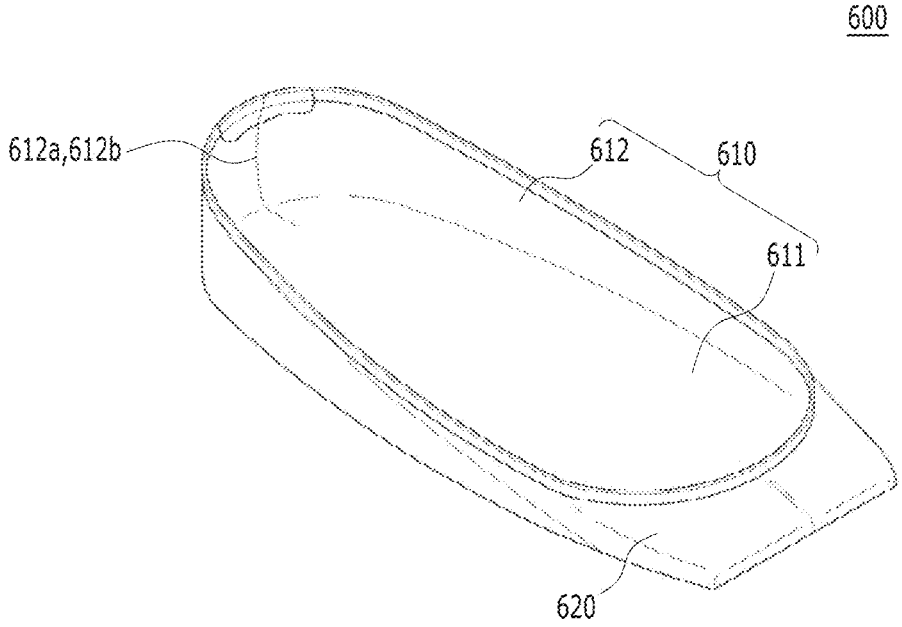
FIG. 5 (Prior Art)
FIG. 5 is a view schematically illustrating the no-show sock manufactured in accordance with the development view of FIG. 4.

The objects, features, and advantages of the present invention will become more apparent with reference to the following embodiments associated with the accompanying drawings.

Specific structural or functional descriptions of embodiments of the present invention are exemplified only for the purpose of explaining the embodiments according to the concept of the present invention, the embodiments according to the concept of the present invention may be carried out in various forms, and it should not be interpreted that the present invention is limited to the embodiments described in the specification of this application.

Because the embodiments according to the concept of the present invention may be variously changed and may have various forms, specific embodiments will be illustrated in the drawings and described in detail in the present specification of this application. However, the descriptions of the specific embodiments are not intended to limit other feasible embodiments according to the concept of the present invention to the specific embodiments as shown in this application, but it should be understood that the present invention covers all modifications, equivalents and alternatives falling within the spirit and technical scope of the present invention.

The terms such as "first" and/or "second" may be used to describe various constituent elements, but these constituent elements should not be limited by these terms. These terms are used only for the purpose of distinguishing one constituent element from other constituent elements. For example, without departing from the scope according to the concept of the present invention, the first constituent element may be referred to as the second constituent element, and similarly, the second constituent element may also be referred to as the first constituent element.

The terms relevant to the directions, such as "upper end", "lower end", "upper side", "lower side", "lateral side", "inner side", and "outer side" are not limited to the orientation of the respective constituent elements, but are simply named to distinguish between the constituent elements.

When one constituent element is described as being "connected" or "coupled" to another constituent element, it should be understood that one constituent element can be connected or coupled directly to another constituent element, and an intervening constituent element can also be present between the constituent elements. On the contrary, when one constituent element is described as being "connected directly to" or "coupled directly to" another constituent element, it should be understood that no intervening constituent element is present between the constituent elements. Other expressions, that is, "between" and "just between" or "adjacent to" and "directly adjacent to", for explaining a relationship between constituent elements, should be interpreted in a similar manner.

The terms used in the present specification of this application are used only for the purpose of describing particular embodiments and are not intended to limit the present invention. Singular expressions include plural expressions unless clearly described as different meanings in the context. In the present application, it will be appreciated that terms "including" and "having" are intended to designate the existence of characteristics, numbers, steps, operations, constituent elements, and components described herein or a combination thereof, and do not exclude a possibility of the existence or addition of one or more other characteristics, numbers, steps, operations, constituent elements, and components, or a combination thereof in advance.

Hereinafter, the present invention will be described in detail by describing the embodiments of the present invention with reference to the accompanying drawings. Like reference numerals indicated in the respective drawings refer to like members.

First Embodiment

First, a blank 1 for manufacturing no-show socks by using a single piece of fabric, a no-show sock 100 manufactured by using the blank 1, and a method of manufacturing the no-show sock 100 according to a first embodiment of the present invention will be described.

In the present specification, the term "blank" means a fabric pattern cut into a single piece in order to manufacture the no-show sock. The term "fabric" means a fabric woven by crossing fiber yarns as a weft and a warp.

Figure 7A:
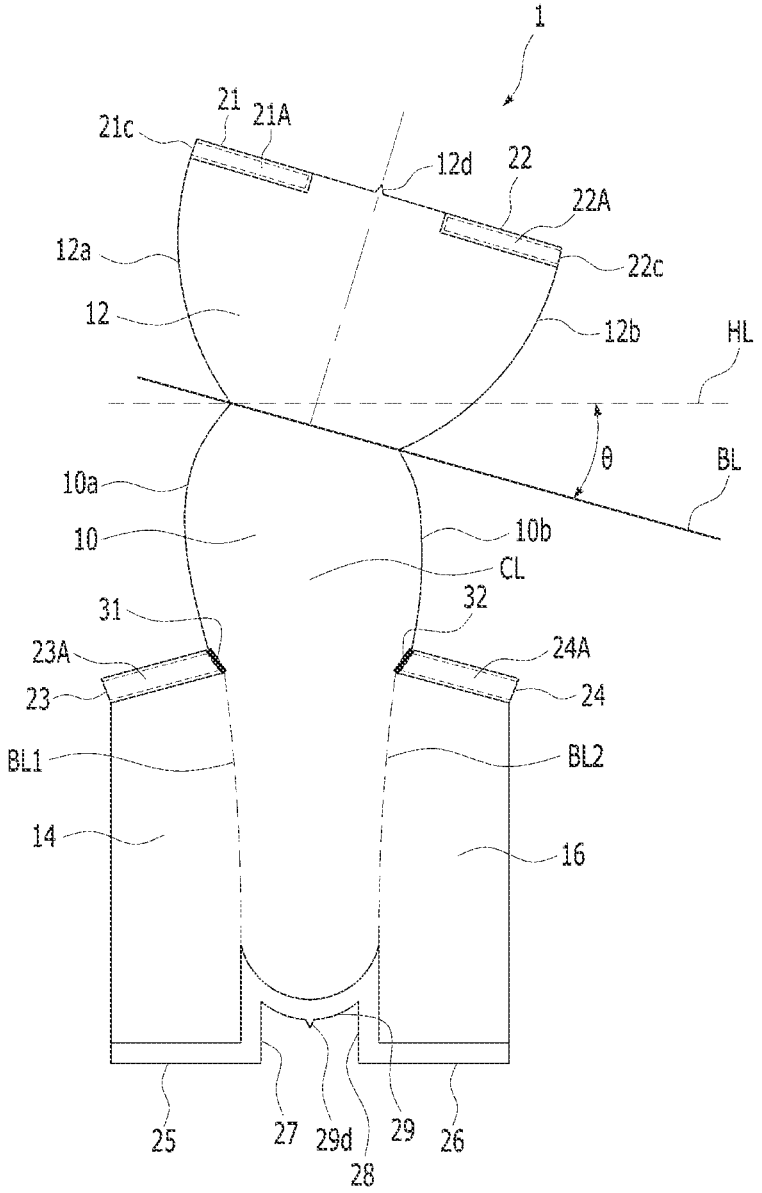
FIG. 7A is a view illustrating a blank for manufacturing no-show socks by using a fabric according to a first embodiment of the present invention.
Figure 7B:
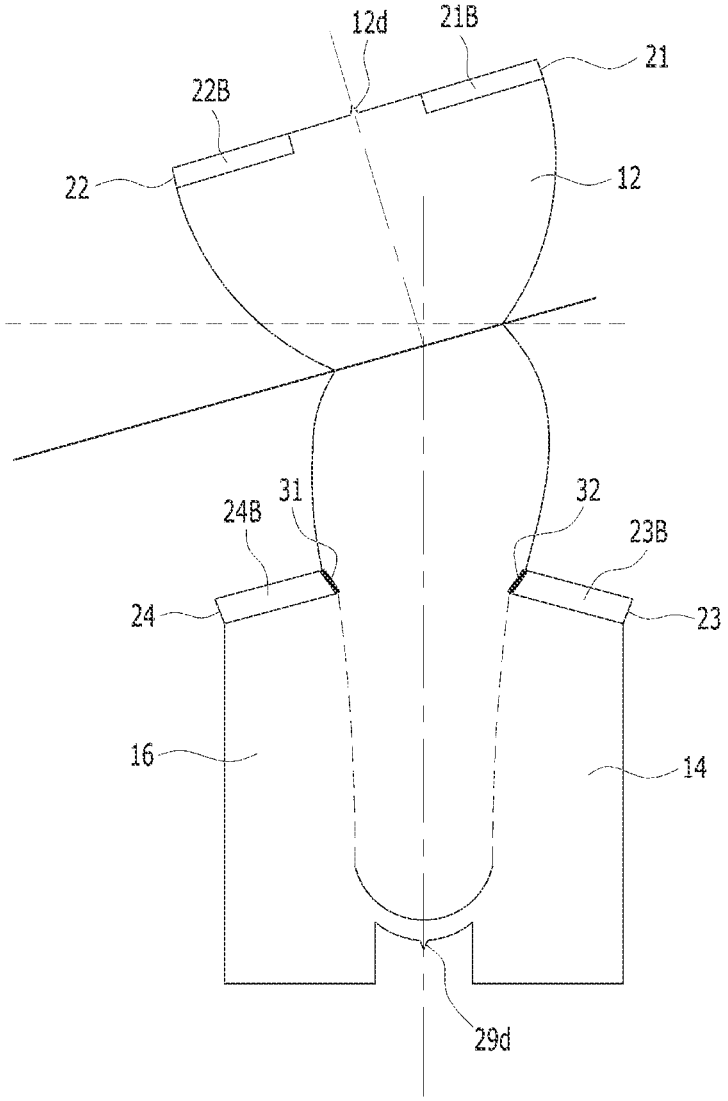
FIG. 7B is a view illustrating a rear surface of the blank in FIG. 7A.

The blank 1 for manufacturing no-show socks by using a fabric according to the first embodiment of the present invention illustrated in FIG. 7A includes: a bottom portion 10 configured to define a bottom of a no-show sock made by a series of fabrics connected integrally; a front portion 12 configured to cover toes and a front foot top; and first and second lateral portions 14 and 16 configured to surround lateral foot sides and a heel. The front portion 12 is connected to an upper end of the bottom portion 10. A boundary line BL on which the bottom portion 10 and the front portion 12 are connected may have a predetermined 5 inclination angle θ with respect to a horizontal line HL perpendicular to a central axis CL of the bottom portion 10. In this case, the inclination angle θ may be about 5° to 30°.

The bottom portion 10 has a contour corresponding to the sole. The first and second lateral portions 14 and 16 are connected to two opposite surfaces of a lower side of the bottom portion 10, respectively. The bottom portion 10 and the first and second lateral portions 14 and 16 may be defined by boundary lines BL1 and BL2. A lower end of the bottom portion 10 has a contour curved and protruding outward to correspond to the heel. A ninth superimposed portion 29 may be formed at a lower end of the bottom portion 10.

A third superimposed portion 23 may be formed at an upper end of the first lateral portion 14. A first cutting line 31 extending to a lower end of the third superimposed portion 23 may be formed inside the third superimposed portion 23. A fifth superimposed portion 25 may be formed at a lower end of the first lateral portion 14. A seventh superimposed portion 27 may be formed inside the first lateral portion 14.

A fourth superimposed portion 24 may be formed at an upper end of the second lateral portion 16. A second cutting line 32 extending to a lower end of the fourth superimposed portion 24 may be formed inside the fourth superimposed portion 24. A sixth superimposed portion 26 may be formed at a lower end of the second lateral portion 16. An eighth superimposed portion 28 may be formed inside the second lateral portion 16.

First and second superimposed portions 21 and 22 may be formed at two opposite sides of an upper end of the front portion 12. Two opposite edges 12*a* and 12*b* of the front portion 12 may have contours corresponding to two opposite edges 10*a* and 10*b* at an upper side of the bottom portion 10.

When the front portion 12 is folded along the boundary line BL to face the bottom portion 10, rear surfaces 21B and 22B of the first and second superimposed portions 21 and 22 at the upper end of the front portion 12 are arranged to overlap a front surface 23A of the third superimposed portion 23 at the upper end of the first lateral portion 14 and a front surface 24A of the fourth superimposed portion 24 at the upper end of the second lateral portion 16, respectively and sewn together at upper and lower ends of the overlapping portion. The two opposite edges 12*a* and 12*b* of the front portion 12 may be aligned to correspond to the two opposite edges 10*a* and 10*b* at the upper side of the bottom portion 10 and sewn together.

The fifth superimposed portion 25 at the lower end of the first lateral portion 14 and the sixth superimposed portion 26 at the lower end of the second lateral portion 16 may overlap each other and be sewn together.

The ninth superimposed portion 29 at the lower end of the bottom portion 10 may overlap with the seventh superimposed portion 27 inside the first lateral portion 14 and the eighth superimposed portion 28 inside the second lateral portion 16 and be sewn together with them.

Next, the no-show sock 100 manufactured by using the blank 1 according to the first embodiment of the present invention will be described. In the description of the no-show sock 100, components and/or elements which are already described above with the description of the above-mentioned blank 1 will be omitted.

Figure 9A:
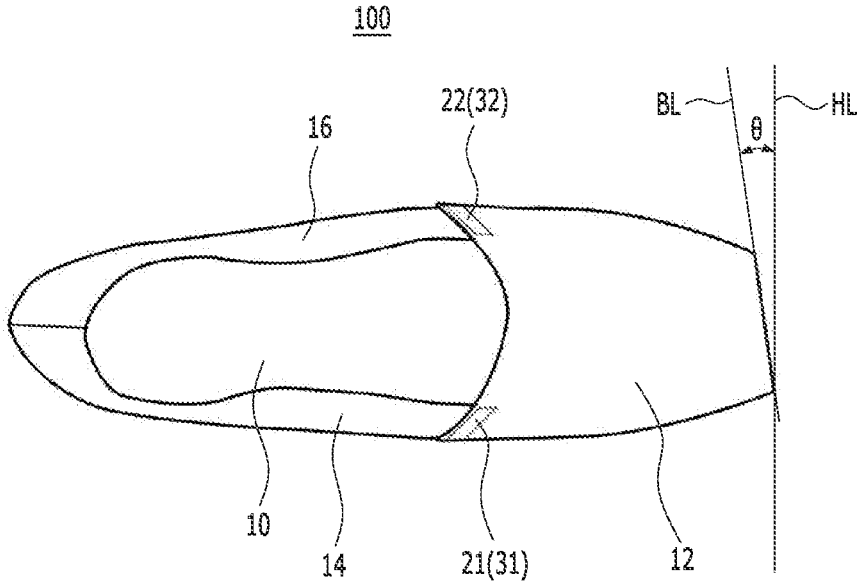
FIGS. 9A, 9B, and 9C are a schematic top plan view, a perspective side view, and a bottom plan view of a no-show sock manufactured by the blank in FIG. 7A, respectively.
Figure 9B:
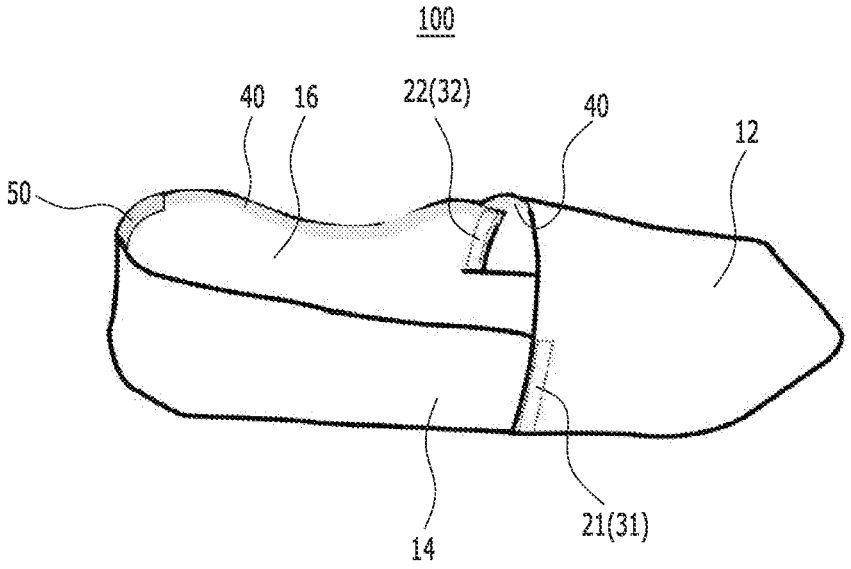
Figure 9C:
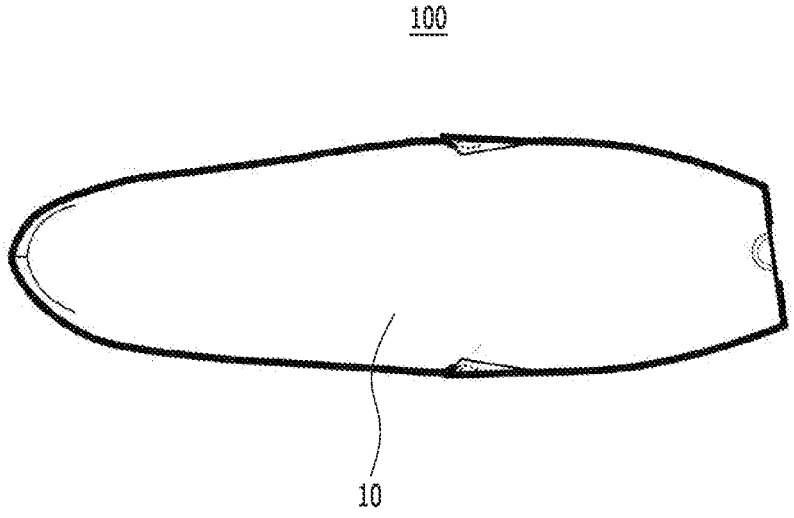

According to the first embodiment of the present invention, the no-show sock 100 manufactured by using the blank 1 made by using a fabric includes: the bottom portion 10 configured to define the bottom made by a series of fabrics connected integrally; the front portion 12 configured to cover the toes and the front foot top; and the first and second lateral portions 14 and 16 configured to surround the lateral foot sides and the heel. The front portion 12 is connected to the upper end of the bottom portion 10. As illustrated in FIGS. 9A and 9B, the boundary line BL on which the bottom portion 10 and the front portion 12 are connected may have the predetermined inclination angle θ with respect to the horizontal line HL perpendicular to the central axis CL of the bottom portion 10. In this case, the inclination angle θ may be about 5° to 30°.

Figure 6A:
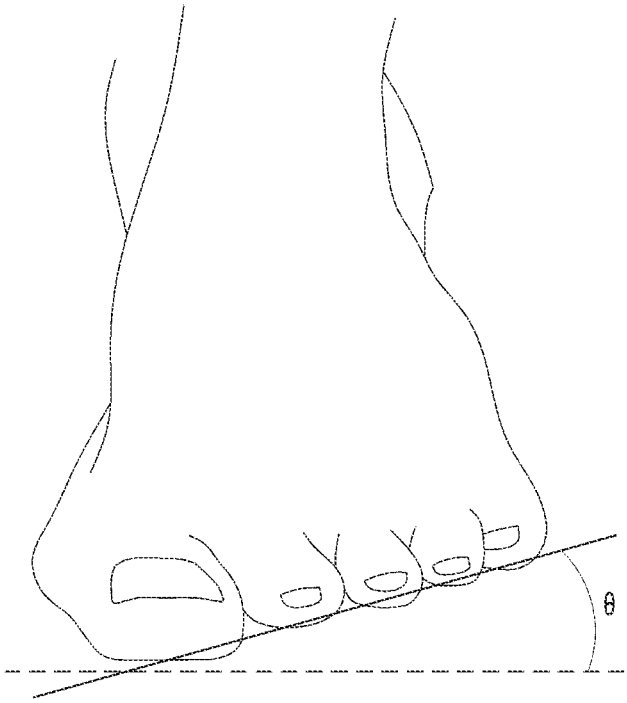
FIG. 6A is a view schematically illustrating toe portions of the human foot.
Figure 6B:
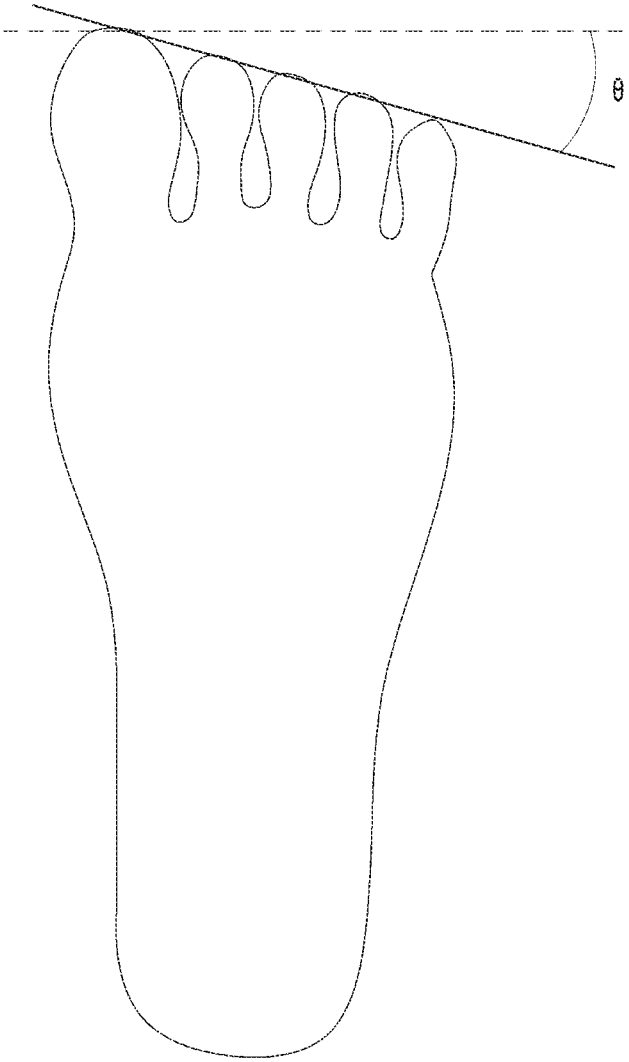
FIG. 6B is a view schematically illustrating a sole of the human foot.

The shape of the human toe portion varies from person to person. However, the big toe and/or the second toe mostly have/has a longer length than the other toes (the third toe and the fourth toe), and the little toe is generally the shortest. In general, as illustrated in FIGS. 6A and 6B, a line (an approximately tangential line), which connects tips of the human toes, has a predetermined inclination angle with respect to the horizontal line perpendicular to the central axis of the sole. Therefore, the inclination angle θ of the boundary line BL, on which the bottom portion 10 and the front portion 12 are connected, with respect to the horizontal line HL perpendicular to the central axis CL of the bottom portion 10 is set to about 5° to 30°. If the inclination angle θ is 5° or less, the portion of the no-show sock, which is in contact with the big toe or the second toe, is somewhat tightly fitted with the big toe or the second toe. For this reason, there is concern that the shape of the foot of a user wearing the no-show sock is not fashionable, the no-show sock does not fit comfortably, and the portion, which is in contact with the big toe or the second toe, is easily damaged. In addition, if the inclination angle θ is 30° or more, the portion of the no-show sock on which the big toe or the second toe is positioned has a large available space, and thus the no-show sock is folded. For this reason, the shape of the foot of the user wearing the no-show sock is not fashionable, and the no-show socks do not fit comfortably. Therefore, the inclination angle θ is set to about 5° to 30°.

In the no-show sock 100 according to the first embodiment of the present invention, the fabric of the bottom portion 10, the front portion 12, and the first and second lateral portions 14 and 16, which constitute the respective component parts of the no-show sock, may be a fabric made by supplying, crossing, and weaving fiber yarns having elasticity as the weft and the warp. The fiber yarn used to manufacture the fabric may be made of merino wool, polyester, nylon, cotton, and the like. The fabric may be appropriately mixed with a flexible material (e.g., rayon, spandex yarns, or the like) at the time of weaving the fabric, which makes it possible to obtain the fabric excellent in elasticity.

In the no-show sock 100 according to the first embodiment of the present invention, the bottom portion 10 may have the contour corresponding to the sole, and the first and second lateral portions 14 and 16 are connected to the two opposite surfaces of the lower side of the bottom portion 10, respectively. The lower end of the bottom portion 10 has the contour curved and protruding outward to correspond to the heel, and the ninth superimposed portion 29 may be formed at the lower end of the bottom portion 10. The third superimposed portion 23 may be formed at the upper end of the first lateral portion 14, and the first cutting line 31 extending to the lower end of the third superimposed portion 23 may be formed inside the third superimposed portion 23, and the fifth superimposed portion 25 may be formed at the lower end of the first lateral portion 14. The seventh superimposed portion 27 may be formed inside the first lateral portion 14, and the fourth superimposed portion 24 may be formed at the upper end of the second lateral portion 16. The second cutting line 32 extending to the lower end of the fourth superimposed portion 24 may be formed inside the fourth superimposed portion 24, and the sixth superimposed portion 26 may be formed at the lower end of the second lateral portion 16. The eighth superimposed portion 28 may be formed inside the second lateral portion 16, and the first and second superimposed portions 21 and 22 may be formed at the two opposite sides of the upper end of the front portion 12. The two opposite edges 12*a* and 12*b* of the front portion have the contours corresponding to the two opposite edges 10*a* and 10*b* of the upper side of the bottom portion 10. When the front portion 12 is folded along the boundary line BL relative to the bottom portion 10, the rear surfaces 21B and 22B of the first and second superimposed portions 21 and 22 at the upper end of the front portion 12 are arranged to overlap the front surface 23A of the third superimposed portion 23 at the upper end of the first lateral portion 14 and the front surface 24A of the fourth superimposed portion 24 at the upper end of the second lateral portion 16, respectively and sewn together at the upper and lower ends of the overlapping portion. The two opposite edges 12*a* and 12*b* of the front portion may be aligned to correspond to the two opposite edges 10*a* and 10*b* of the upper side of the bottom portion 10 and sewn together. The fifth superimposed portion 25 at the lower end of the first lateral portion 14 and the sixth superimposed portion 26 at the lower end of the second lateral portion 16 may overlap each other and be sewn together. The ninth superimposed portion 29 at the lower end of the bottom portion 10 may overlap with the seventh superimposed portion 27 inside the first lateral portion 14 and the eighth superimposed portion 28 inside the second lateral portion 16 and be sewn together with them.

Figure 8A:
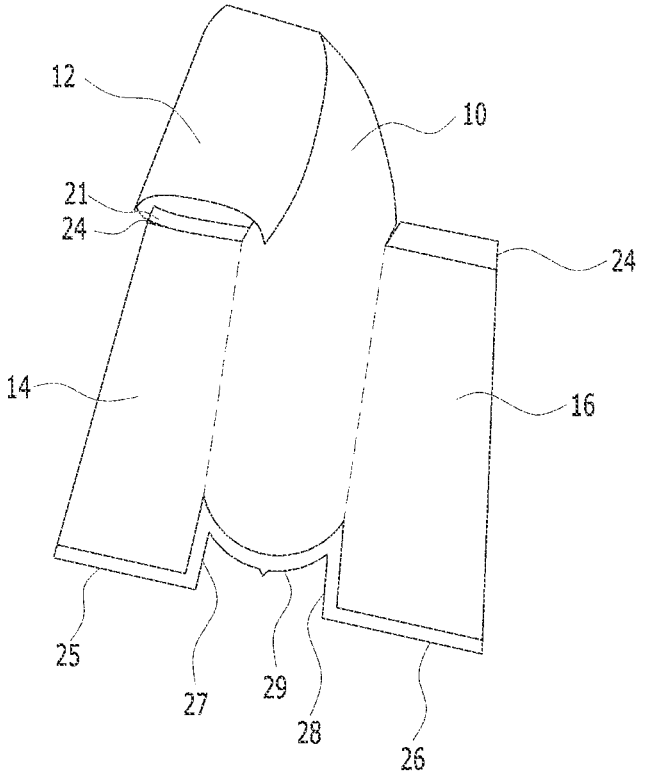
FIGS. 8A and 8B are views schematically illustrating a process of manufacturing a no-show sock by using the blank in FIG. 7A, respectively.
Figure 8B:
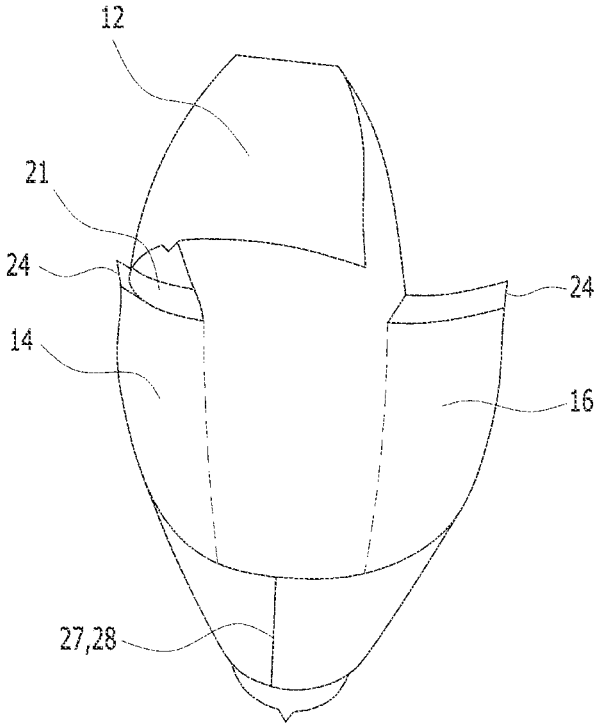

With this configuration, when the front portion 12 is folded along the boundary line BL relative to the bottom portion 10, the rear surface 21B of the first superimposed portion 21 at the upper end of the front portion 12 is arranged to overlap the front surface 23A of the third superimposed portion 23 at the upper end of the first lateral portion 14 as illustrated in FIG. 8A. Likewise, the rear surface 22B of the second superimposed portion 22 at the upper end of the front portion 12 is arranged to overlap the front surface 24A of the fourth superimposed portion 24 at the upper end of the second lateral portion 16. In this process, an outer end 21*c* of the first superimposed portion 21 at the upper end of the front portion 12 is arranged inside the third superimposed portion 23 of the first lateral portion 14, and an outer end 22*c* of the second superimposed portion 22 at the upper end of the front portion 12 is arranged inside the fourth superimposed portion 24 of the second lateral portion 16. Therefore, the upper end of the front portion 12 is curved outward and easily spaced apart from the bottom portion 10, such that the no-show sock may be manufactured in a shape which the foot is easily inserted into the no-show sock. In addition, when the front portion 12 is folded along the boundary line BL relative to the bottom portion 10, the outer end 21*c* of the first superimposed portion 21 of the front portion 12 is aligned with the first cutting line 31 of the first lateral portion 14, and the outer end 22*c* of the second superimposed portion 22 of the front portion 12 is aligned with the second cutting line 32 of the second lateral portion 14. Therefore, the first and second superimposed portions 21 and 22 of the front portion 12 may be accurately aligned with the third and fourth superimposed portions 23 and 24 of the bottom portion 10.

In addition, a bonding agent may be applied between the rear surface 21B of the first superimposed portion 21 of the front portion 12 and the front surface 23A of the third superimposed portion 23 of the first lateral portion 14 and between the rear surface 22B of the second superimposed portion 22 of the front portion 12 and the front surface 24A of the fourth superimposed portion 24 of the second lateral portion 16. A publicly-known bonding agent capable of bonding fiber, leather, wood, and the like may be used as the bonding agent. With this configuration, a coupling force between the first superimposed portion 21 and the third superimposed portion 23 and a coupling force between the second superimposed portion 22 and the fourth superimposed portion 24 may increase. Further, the first superimposed portion 21 and the third superimposed portion 23 may be temporarily joined, and the second superimposed portion 22 and the fourth superimposed portion 24 may be temporarily joined, such that the efficiency of the sewing operation may be improved.

In addition, as illustrated in FIG. 7A, a protrusion 12*d* protruding outward along the centerline CL of the front portion 12 is formed at a center of the upper end of the front portion 12, and the protrusion 12*d* is aligned with the centerline CL of the bottom portion 10, such that the center of the upper end of the front portion 12 may be appropriately aligned with the center of the bottom portion 10.

In a state in which the first and second superimposed portions 21 and 22 of the front portion 12 overlap the third superimposed portion 23 of the first lateral portion 14 and the fourth superimposed portion 24 of the second lateral portion 16, respectively, the first superimposed portion 21 of the front portion 12 and the third superimposed portion 23 of the first lateral portion 14 may be sewn in one or more lines by sewing or the like, and the second superimposed portion 22 of the front portion 12 and the fourth superimposed portion 24 of the second lateral portion 16 may be sewn in one or more lines by sewing or the like. The coupling portion between the first superimposed portion 21 of the front portion 12 and the third superimposed portion 23 of the first lateral portion 14 and the coupling portion between the second superimposed portion 22 of the front portion 12 and the fourth superimposed portion 24 of the second lateral portion 16 may be sewn so that a sewn line has a 'C' shape because stress is concentrated on the coupling portions. Therefore, it is possible to increase the coupling force.

In addition, the two opposite edges 12*a* and 12*b* of the front portion 12 may be aligned to correspond to the two opposite edges 10*a* and 10*b* of the upper side of the bottom portion 10, respectively and sewn together. In this case, for example, one-line or two-line linear sewing may be performed by a sewing machine, and the edge may be finished by an overlocking process. In addition, the one-line linear sewing and the overlocking process may be simultaneously performed.

Meanwhile, the fifth superimposed portion 25 at the lower end of the first lateral portion 14 and the sixth superimposed portion 26 at the lower end of the second lateral portion 16, which define the heel portion of the no-show sock, may overlap each other and be sewn together. In this case, the ninth superimposed portion 29 at the lower end of the bottom portion 10 may overlap with the seventh superimposed portion 27 inside the first lateral portion 14 and the eighth superimposed portion 28 inside the second lateral portion 16 and be sewn together with them. During the sewing operation, one-line or two-line linear sewing may be performed by the sewing machine, and the edge may be finished by the overlocking process. In addition, the one-line linear sewing and the overlocking process may be simultaneously performed.

In this case, a protrusion 29*d* protruding outward along the centerline CL of the bottom portion 10 may be formed at the center of the ninth superimposed portion 29 at the lower end of the bottom portion 10 so that the overlapping portion between the fifth superimposed portion 25 of the first lateral portion 14 and the sixth superimposed portion 26 of the second lateral portion 16 may be aligned with the centerline CL of the bottom portion 10 at the lower end of the bottom portion 10. The protrusion 29*d* may be a reference point based on which the overlapping portion between the fifth superimposed portion 25 and the sixth superimposed portion 26 is disposed. The use of the centering reference point may improve the efficiency of the operation of sewing the no-show sock and prevent the deterioration in quality of the product that may be caused by misalignment.

In the no-show sock 100 according to the first embodiment of the present invention, a boundary portion between the bottom portion 10 and the front portion 12 is a portion with which the toes come into contact, and the boundary portion is easily vulnerable to the friction with the toe and tends to be easily abraded or damaged in comparison with the other portions. Therefore, a reinforcing fabric 30 may be attached along the boundary line BL between the bottom portion 10 and the front portion 12 to improve the durability of the no-show sock. Typically, the fabric for the no-show sock is set such that an expansion/contraction ratio in a vertical direction (lengthwise direction) is larger than an expansion/contraction ratio in a horizontal direction (crosswise direction) so that the fabric for the no-show sock is more appropriately expanded in the longitudinal direction of the foot. The reinforcing fabric 30 attached to the no-show sock 100 according to the first embodiment present the of the invention may be set such that expansion/contraction ratio in the vertical direction (lengthwise direction) is larger than the expansion/contraction ratio in the horizontal direction (crosswise direction). If the expansion/contraction ratio of the reinforcing fabric in the vertical direction (lengthwise direction) is smaller than the expansion/contraction ratio of the reinforcing fabric in the horizontal direction (crosswise direction) even though the expansion/contraction ratio of the fabric of the no-show sock in the vertical direction (lengthwise direction) is larger than the expansion/contraction ratio of the fabric of the no-show sock in the horizontal direction (crosswise direction), the big toe portion or the second toe portion is tightened, which may cause a feeling of restlessness and deterioration in wearing comfort of the no-show sock. Therefore, to provide comfortable wearing comfort, the reinforcing fabric 30 may be set such that the expansion/contraction ratio in the vertical direction (lengthwise direction) is larger than the expansion/contraction ratio in the horizontal direction (crosswise direction) so that the fabric of the no-show sock and the fabric of the reinforcing fabric may have approximately uniform expansion/contraction ratios in the same direction.

The reinforcing fabric 30 may be made of the same material as the no-show sock 100 or made of a material different from and having higher durability than the material of the no-show sock.

Figure 10:
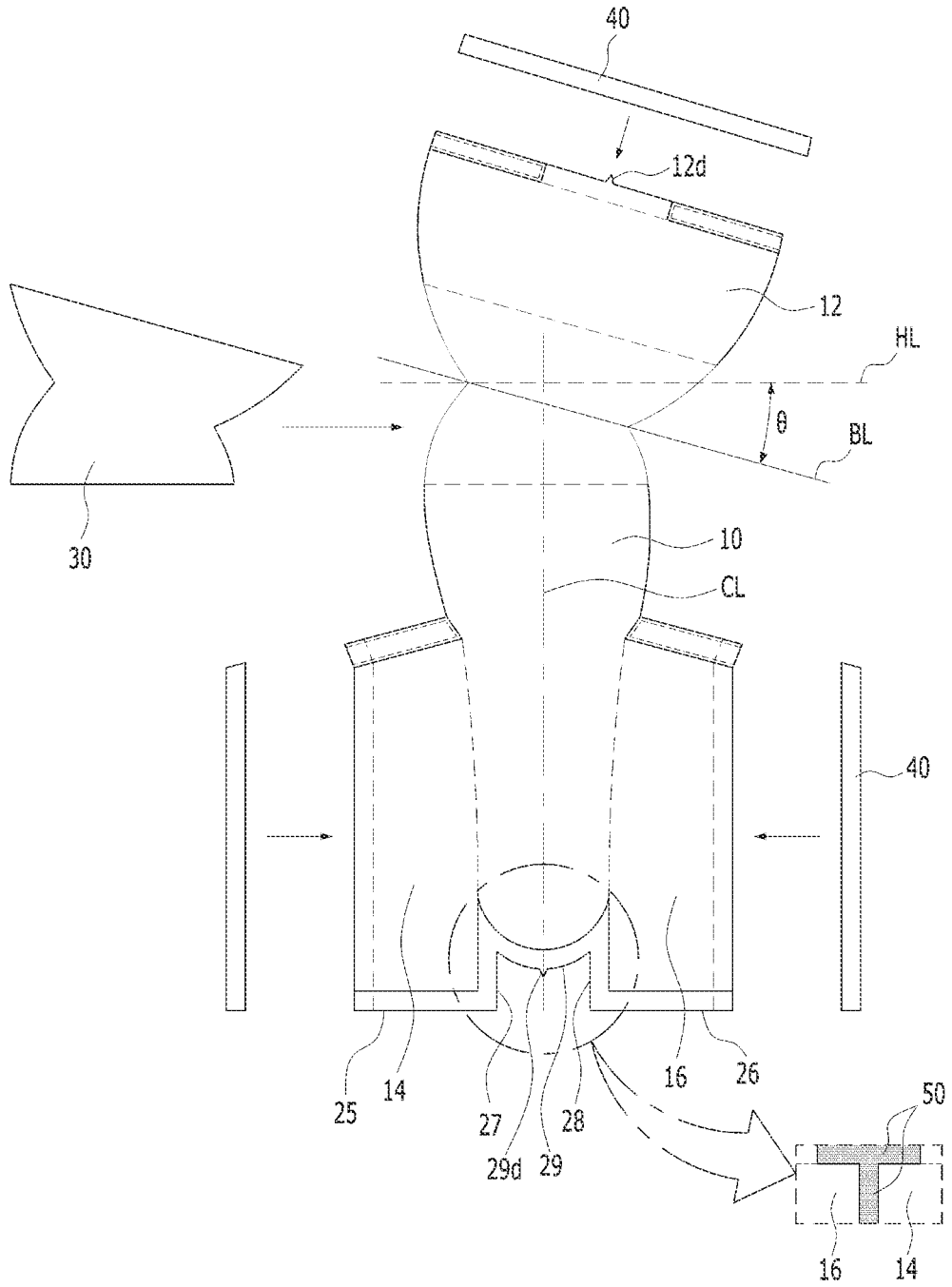
FIG. 10 is a view illustrating a state in which a reinforcing fabric, an elastic band, and a silicone friction member are attached to the blank for manufacturing a no-show sock by using a fabric according to the first embodiment of the present invention.

A crew sock has a narrow ankle portion, and the ankle portion of the sock tightens and holds the ankle of the user wearing the sock. For this reason, the sock is not easily pulled off. In contrast, because the no-show sock has a relatively larger opening portion than the crew sock, the no-show sock has a low force for tightening and holding the wearer's foot top, such that the opening portion of the no-show sock tends to be easily expanded. To improve the above-mentioned configuration, as illustrated in FIG. 10, elastic bands 40 may be attached to the edge of the upper end of the front portion 12 of the no-show sock, the edge of the first lateral portion 14, and the edge of the second lateral portion 16, respectively. For example, a high-elasticity band manufactured in the form of a strap made by winding a fabric material around a plurality of rubber strips may be used as the elastic band. Because the elastic band 40 is attached, a contraction force is applied to the opening portion of the no-show sock, such that the opening portion of the no-show sock may be in stably close contact with the wearer's foot top.

In addition, in the no-show sock 100 according to the first embodiment of the present invention, a silicone friction member 50 may be attached to an outer portion of the overlapping portion between the fifth superimposed portion 25 of the first lateral portion 14 and the sixth superimposed portion 26 of the second lateral portion 16. In addition, the silicone friction member 50 may be attached to a portion of the edge of the first lateral portion 14 and a portion of the edge of the second lateral portion 16 that correspond to the heel. With this configuration, the "T"-shaped silicone friction member 50 is disposed on an inner portion of the no-show sock 100, which comes into contact with the heel, as illustrated in the right lower end of FIG. 10, such that the friction member 50 comes into contact with the wearer's heel in the horizontal and vertical directions. Therefore, the wearing stability of the no-show sock may be improved, and a frictional force between the no-show sock and the heel may be increased, which makes it possible to prevent the no-show sock from being pulled off when the user takes off the shoe.

Next, a method of manufacturing the no-show sock 100 by using a fabric according to the first embodiment of the present invention will be described. In the description of the method of manufacturing the no-show sock 100, components and/or elements which are described above with the descriptions of the above-mentioned blank land the no-show sock 100 will be omitted.

First, the fabric made of a material having elasticity is cut into the shape of blank 1 (single piece of pattern) illustrated in FIG. 7A (S10).

In this case, a plurality of sheets of blanks 1 are manufactured by stacking a plurality of sheets (e.g., about 100 sheets) of fabrics each having a predetermined horizontal× vertical dimension (e.g., a horizontal length of about 150 cm×a vertical length of about 300 cm), positioning a marker (not illustrated), which is manufactured to have the same shape as the blank 1, on the upper surface of the fabrics, and cutting the plurality of sheets of fabrics into the shape identical to the shape of the marker by using a cutting machine or the like. The fabric made by supplying, crossing, and weaving the fiber yarns having elasticity as the weft and the warp may be used as the fabric.

The blank 1 illustrated in FIG. 7A includes: the bottom portion 10 configured to define the bottom of the no-show sock made by a series of fabrics connected integrally; the front portion 12 configured to cover toes and the front foot top; and the first and second lateral portions 14 and 16 configured to surround the lateral foot sides and the heel. The front portion 12 is connected to the upper end of the bottom portion 10. The boundary line BL on which the bottom portion 10 and the front portion 12 are connected may have the predetermined inclination angle θ with respect to the horizontal line HL perpendicular to the central axis CL of the bottom portion 10. In this case, the inclination angle θ may be about 5° to 30°.

Next, the front portion 12 of the blank 1 is folded along the boundary line BL between the front portion 12 and the bottom portion 10 relative to the bottom portion 10 (S20).

Next, the outer end 21*c* of the first superimposed portion 21 of the front portion 12 is aligned with the first cutting line 31 of the first lateral portion 14 so that the rear surface 21B of the first superimposed portion 21 of the front portion 12 overlaps the front surface 23A of the third superimposed portion 23 of the first lateral portion 14. Further, the outer end 22*c* of the second superimposed portion 22 of the front portion 12 is aligned with the second cutting line 32 of the second lateral portion 14 so that the rear surface 22B of the second superimposed portion 22 of the front portion 12 overlaps the front surface 24A of the fourth superimposed portion 24 of the second lateral portion 16 (S30).

Next, the first superimposed portion 21 of the front portion 12 and the third superimposed portion 23 of the first lateral portion 14 are sewn in one or more lines, the second superimposed portion 22 of the front portion 12 and the fourth superimposed portion 24 of the second lateral portion 16 are sewn in one or more lines, and the two opposite edges 12*a* and 12*b* of the front portion 12 and the two opposite edges 10*a* and 10*b* of the upper side of the bottom portion 10 are sewn in one or more lines, respectively (S40). In this case, the coupling portion between the first superimposed portion 21 of the front portion 12 and the third superimposed portion 23 of the first lateral portion 14 and the coupling portion between the second superimposed portion 22 of the front portion 12 and the fourth superimposed portion 24 of the second lateral portion 16 may be sewn so that a sewn line has a 'C' shape because stress is concentrated on the coupling portions. Therefore, it is possible to increase the coupling force.

Next, the fifth superimposed portion 25 at the lower end of the first lateral portion 14 and the sixth superimposed portion 26 at the lower end of the second lateral portion 16 overlap each other and are sewn in one or more lines (S50).

Next, the ninth superimposed portion 29 at the lower end of the bottom portion 10 may overlap with the seventh superimposed portion 27 inside the first lateral portion 14 and the eighth superimposed portion 28 inside the second lateral portion 16 to be sewn in one or more lines (S60).

In the method of manufacturing the no-show sock 100 according to the modified example of the first embodiment of the present invention, the plurality of sheets of blanks 100 are cut by the process S10, and then the processes described below may be selectively performed before the process S20 is performed.

The elastic bands 40 may be temporarily joined to the edge of the upper end of the front portion 12 of the blank 1, the edge of the first lateral portion 14, and the edge of the second lateral portion 16, respectively (an initial operation is performed), or the reinforcing fabric 30 having a predetermined vertical height is temporarily joined along the boundary line BL between the bottom portion 10 and the front portion 12, and then a thermal pressing operation (a pressing operation performed while applying heat) may be performed on the temporarily joined portion of the elastic band 40 and/or the temporarily joined portion of the reinforcing fabric 30 (S70). In this case, the reinforcing fabric 30 may be arranged so that the expansion/contraction ratio in the vertical direction (lengthwise direction) is larger than the expansion/contraction ratio in the horizontal direction (crosswise direction). In addition, the "T"-shaped silicone friction member 50 may be attached to the portion of the no-show sock that corresponds to the heel (S80). In this case, silicone may be applied to the portion of the no-show sock corresponding to the heel, or the portion of the no-show sock corresponding to the heel may be applied or coated with silicone, instead of attaching the silicone friction member 50.

The sock manufactured by the method of manufacturing the no-show sock 100 according to the first embodiment of the present invention described above is turned inside out and worn so that the sewn line, the reinforcing fabric, the elastic band, the silicone friction member, and the like are disposed inside the no-show sock.

Second Embodiment

Next, a blank 2 for manufacturing no-show socks by using a fabric, a no-show sock 200 manufactured by using the blank 2, and a method of manufacturing the no-show sock 200 according to a second embodiment of the present invention will be described with reference to FIGS. 11 to 13. The description will be made focusing on the configuration and operation of the blank 2 for manufacturing the no-show sock by using the fabric, the no-show sock 200, and the method of manufacturing the no-show sock 200 according to the second embodiment that are different from the those in the first embodiment.

According to the comparison between the blank 2 for manufacturing the no-show sock by using the fabric and the no-show sock 200 according to the second embodiment and the blank 1 and the no-show sock 100 according to the first embodiment, the front portion 12 according to the first embodiment surrounds the lateral sides of the toes and the lateral sides of the tiptoes, such that the connection line (e.g., the sewn line, the hot melt joint line, or the like) of the coupling portion between the front portion 12 and the bottom portion 10 is positioned at lower lateral sides of the toes and tiptoes, which may cause heterogeneity different from the contact with the fabric of the no-show sock. In contrast, the second embodiment differs from the first embodiment in that a first lateral portion 214 and a second lateral portion 216 surround the lateral sides of the toes and the lateral sides of the tiptoes, such that the connection line (e.g., a seam sealing portion or the like) of the coupling portion between a front portion 212 and a bottom portion 210 is disposed at upper lateral sides of the toes and tiptoes, which may eliminate heterogeneity different from the contact with the fabric of the no-show sock. With this configuration, the wearing comfort of the no-show sock may be improved.

In addition, in the blank 1 and the no-show sock 100 according to the first embodiment, the two opposite edges 12*a* and 12*b* of the front portion 12 are sewn together with the two opposite edges 10*a* and 10*b* of the bottom portion 10 corresponding to the two opposite edges 12*a* and 12*b*, and the first and second superimposed portions 21 and 22 at the upper end of the front portion 12 are sewn together with the third superimposed portion 23 at the upper end of the first lateral portion 14 and the fourth superimposed portion 24 of the second lateral portion 16. In contrast, the second embodiment differs from the first embodiment in that in the blank 2 and the no-show socks 200 according to the second embodiment, two opposite edges 212*a* and 212*b* of the front portion 212 are seam-sealed together with an upper edge 214*a* of the first lateral portion 214 and an upper edge 216B of the second lateral portion 216, such that the portion of the no-show sock, which comes into contact with the front foot top, has no sewn line.

The blank 1 and the no-show sock 100 according to the first embodiment are approximately similar in configuration and operation to those of the second embodiment, except for the above-mentioned two differences.

Figure 11:
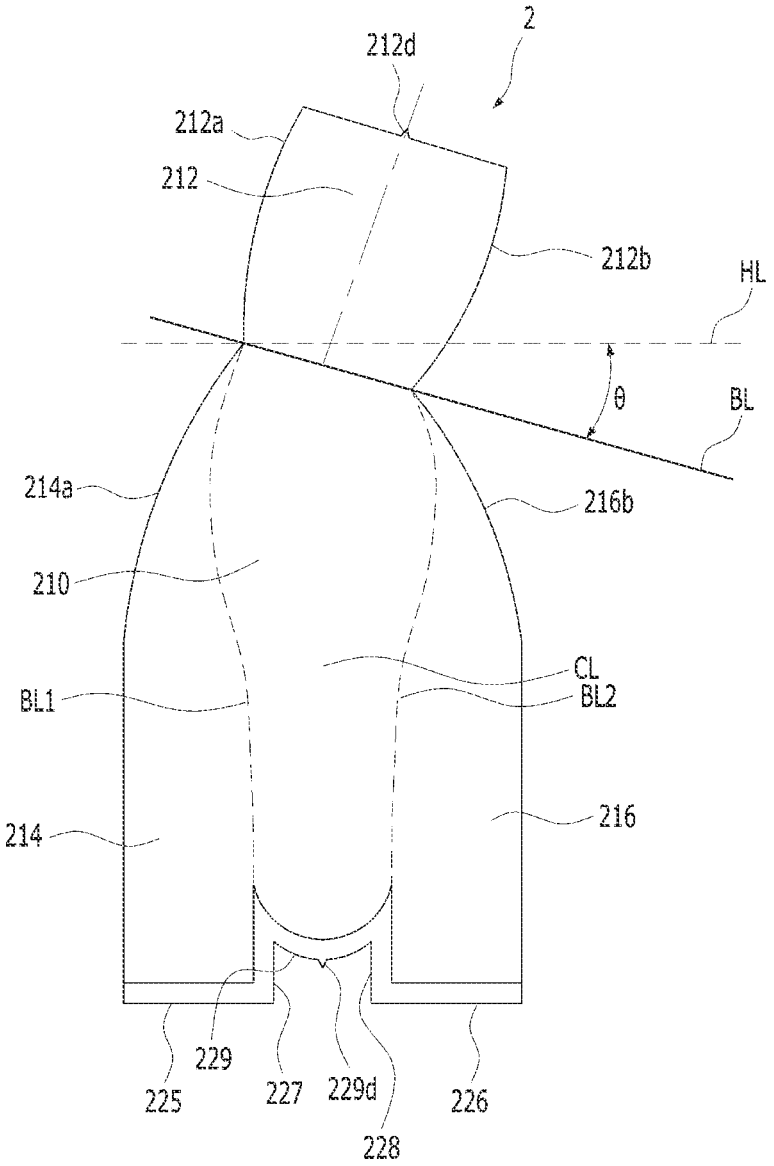
FIG. 11 is a view illustrating a blank for manufacturing no-show socks by using a fabric according to a second embodiment of the present invention.
Figure 12A:
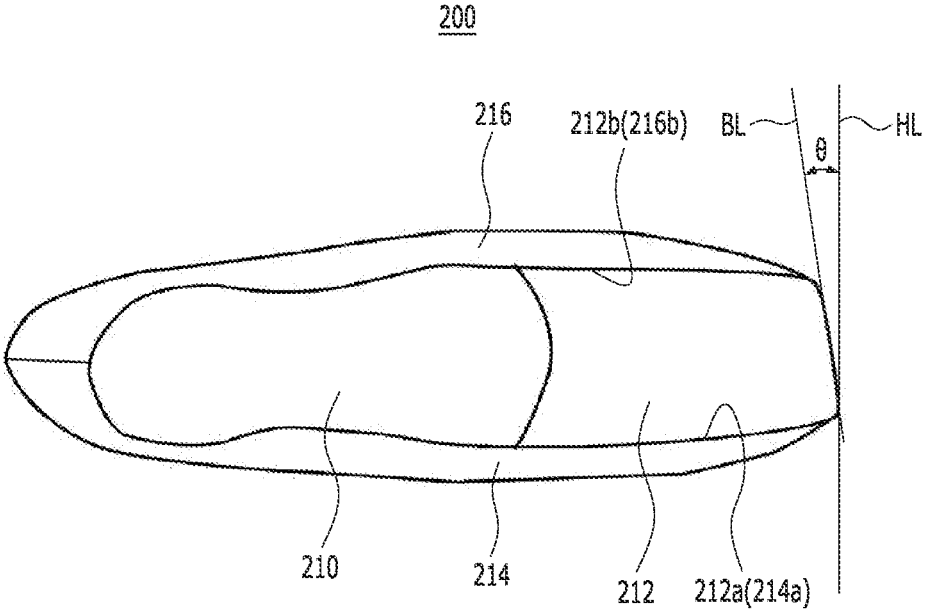
FIGS. 12A, 12B, and 12C are a schematic top plan view, a perspective side view, and a bottom plan view of a no-show sock manufactured by the blank in FIG. 11, respectively.

The blank 2 for manufacturing no-show socks by using a fabric according to the second embodiment of the present invention illustrated in FIG. 11 includes: the bottom portion 210 configured to define a bottom of a no-show sock made by a series of fabrics connected integrally, and having a contour corresponding to the sole; the front portion 212 having a contour corresponding to the toes and the front foot top; and the first and second lateral portions 214 and 216 configured to surround the lateral foot sides and the heel. The front portion 212 is connected to an upper end of the bottom portion 210. The boundary line BL on which the bottom portion 210 and the front portion 212 are connected may have a predetermined inclination angle θ with respect to the horizontal line HL perpendicular to the central axis CL of the bottom portion 210. In this case, the inclination angle θ may be about 5° to 30°.

The first and second lateral portions 214 and 216 may be connected to the two opposite surfaces of the bottom portion 210, respectively.

The two opposite edges 212*a* and 212*b* of the front portion may have contours corresponding to the upper edge 214*a* of the first lateral portion 214 and the upper edge 216*b* of the second lateral portion 216, respectively.

When the front portion 212 is folded along the boundary line BL relative to the bottom portion 210, the two opposite edges 212*a* and 212*b* of the front portion are aligned and coincident with the upper edge 214*a* of the first lateral portion 214 and the upper edge 216*b* of the second lateral portion 216, respectively and seam-sealed together. In this case, a hot-melt process in the prior art may be performed instead of the seam sealing process. A detailed description thereof will be omitted.

Next, the no-show sock 200 manufactured by using the blank 2 according to the second embodiment of the present invention will be described. In the description of the no-show sock 200, components and/or elements which are described above with the description of the above-mentioned blank 2 will be omitted.

According to the second embodiment of the present invention, the no-show sock 200 manufactured by using the blank 2 made by using a fabric includes: the bottom portion 210 configured to define the bottom of the no-show sock made by a series of fabrics connected integrally, and having the contour corresponding to the sole; the front portion 212 having a contour corresponding to the toes and the front foot top; and the first and second lateral portions 214 and 216 configured to surround the lateral foot sides and the heel. The front portion 212 is connected to the upper end of the bottom portion 210. As illustrated in FIG. 11, the boundary line BL on which the bottom portion 210 and the front portion 212 are connected has the predetermined inclination angle θ with respect to the horizontal line HL perpendicular to the central axis CL of the bottom portion 210.

In this case, the inclination angle θ may be about 5° to 30°. If the inclination angle is 5° or less, the portion of the no-show sock, which is in contact with the big toe or the second toe, is somewhat tightly fitted with the big toe or the second toe. For this reason, there is concern that the shape of the foot of the user wearing the no-show sock is not aesthetic, the wearing comfort deteriorates, and the portion, which is in contact with the big toe or the second toe, is easily damaged. In addition, if the inclination angle is 30° or more, the portion of the no-show sock on which the big toe or the second toe is positioned has a large available space, and thus the no-show sock is folded. For this reason, the shape of the foot of the user wearing the no-show sock is not aesthetic, and the wearing comfort also deteriorates.

In the no-show socks 200 according to the second embodiment of the present invention, the bottom portion 210, the front portion 212, and the first and second lateral portions 214 and 216, which constitute the respective component parts of the no-show sock, may be made by a fabric made by crossing and weaving the weft and the warp having elasticity. The fiber yarn used to manufacture the fabric may be made of merino wool, polyester, nylon, cotton, and the like. The fabric may be appropriately mixed with a flexible material (e.g., rayon, spandex yarns, or the like) at the time of weaving the fabric, which makes it possible to obtain the fabric excellent in elasticity.

Figure 12B:
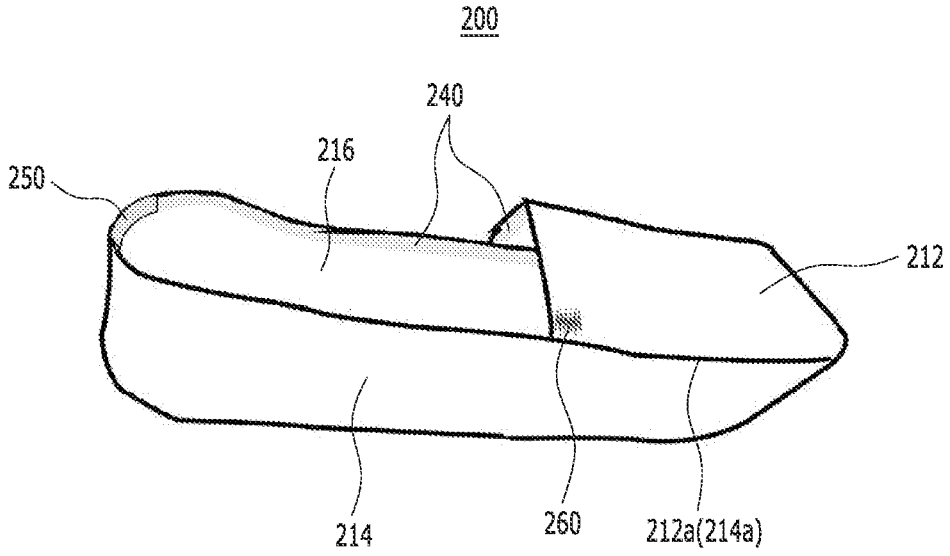
Figure 12C:
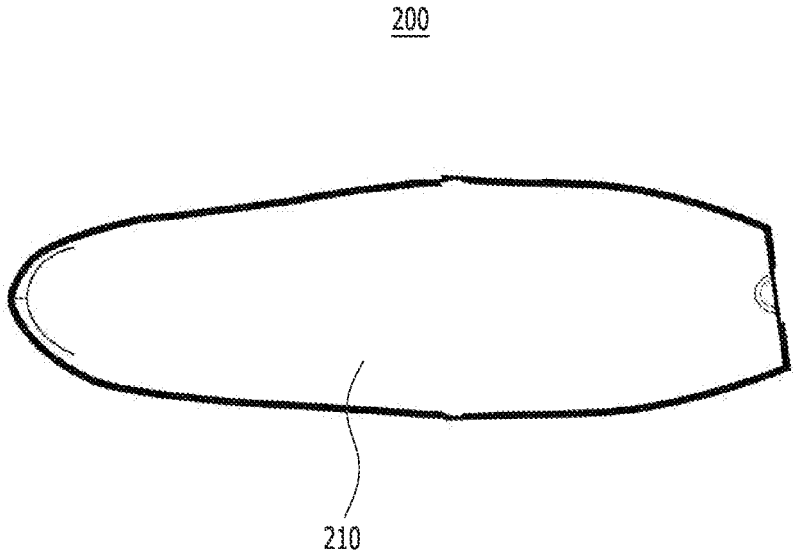

In the no-show socks 200 according to the second embodiment of the present invention, the first and second lateral portions 214 and 216 are connected to the two opposite surfaces of the bottom portion 210, respectively, a lower end of the bottom portion 210 has a contour curved and protruding outward to correspond to the heel, and a ninth superimposed portion 229 is formed at a lower end of the bottom portion 210. A fifth superimposed portion 225 is formed at a lower end of the first lateral portion 214, a seventh superimposed portion 227 is formed inside the first lateral portion 214, and a sixth superimposed portion 226 is formed at a lower end of the second lateral portion 216. An eighth superimposed portion 228 is formed inside the second lateral portion 216, and the two opposite edges 212*a* and 212*b* of the front portion 212 have contours corresponding to the upper edge 214*a* of the first lateral portion 214 and an upper edge 216A of the second lateral portion 216, respectively. When the front portion 212 is folded along the boundary line BL relative to the bottom portion 210, the two opposite edges 212*a* and 212*b* of the front portion 212 are aligned and coincident with the upper edge 214*a* of the first lateral portion 214 and the upper edge 216*b* of the second lateral portion 216, respectively and seam-sealed together. In this case, as illustrated in FIG. 12B, a bar tack 260 may be formed to densely sew the end portions where the two opposite edges 212*a* and 212*b* of the front portion 212 are seam-sealed with the upper edge 214*a* of the first lateral portion 214 and the upper edge 216*b* of the second lateral portion 216 because stress is concentrated on the end portions. The bar tack 260 may have the same color as the no-show sock 200 or have a color different from the color of the no-show sock 200. The bar tack 260 may be a design point of the no-show socks 200.

In addition, the fifth superimposed portion 225 at the lower end of the first lateral portion 214 and the sixth superimposed portion 226 at the lower end of the second lateral portion 216 may overlap each other and be sewn together. The ninth superimposed portion 229 at the lower end of the bottom portion 210 may overlap with the seventh superimposed portion 227 inside the first lateral portion 214 and the eighth superimposed portion 228 inside the second lateral portion 216 and be sewn together with them.

In addition, as illustrated in FIG. 11, a protrusion 212*d* protruding outward along the centerline CL of the front portion 212 is formed at a center of the upper end of the front portion 212, and the protrusion 212*d* is aligned with the centerline CL of the bottom portion 210, such that the center of the upper end of the front portion 212 may be appropriately aligned with the center of the bottom portion 210.

Meanwhile, the fifth superimposed portion 225 at the lower end of the first lateral portion 214 and the sixth superimposed portion 226 at the lower end of the second lateral portion 216, which define the heel portion of the no-show sock, may overlap each other and be sewn together. In this case, the ninth superimposed portion 229 at the lower end of the bottom portion 210 may overlap with the seventh superimposed portion 227 inside the first lateral portion 214 and the eighth superimposed portion 228 inside the second lateral portion 216 and be sewn together with them. During the sewing operation, one-line or two-line linear sewing may be performed by the sewing machine, and the edge may be finished by the overlocking process. In addition, the one-line linear sewing and the overlocking process may be simultaneously performed.

In this case, a protrusion 229*d* protruding outward along the centerline CL of the bottom portion 210 may be formed at the center of the ninth superimposed portion 229 at the lower end of the bottom portion 210 so that the overlapping portion between the fifth superimposed portion 225 of the first lateral portion 214 and the sixth superimposed portion 226 of the second lateral portion 216 may be aligned with the centerline CL of the bottom portion 210 at the lower end of the bottom portion 210. The protrusion 229*d* may be a reference point based on which the overlapping portion between the fifth superimposed portion 225 and the sixth superimposed portion 226 is disposed. The use of the centering reference point may improve the efficiency of the operation of sewing the no-show sock and prevent the deterioration in quality of the product that may be caused by misalignment.

In the no-show sock 200 according to the second embodiment of the present invention, a boundary portion between the bottom portion 210 and the front portion 212 is a portion with which the toes come into contact, and the boundary portion is easily vulnerable to the friction with the toe and tends to be easily abraded or damaged in comparison with the other portions. Therefore, a reinforcing fabric 230 may be attached along the boundary line BL between the bottom portion 210 and the front portion 212 to improve the durability of the no-show sock.

Typically, the fabric for the no-show sock is set such that an expansion/contraction ratio in a vertical direction (lengthwise direction) is larger than an expansion/contraction ratio in a horizontal direction (crosswise direction) so that the fabric for the no-show sock is more appropriately expanded in the longitudinal direction of the foot. The reinforcing fabric 230 attached to the no-show sock 200 according to the second embodiment of the present invention may be set such that the expansion/contraction ratio in the vertical direction (lengthwise direction) is larger than the expansion/contraction ratio in the horizontal direction (crosswise direction). If the expansion/contraction ratio of the reinforcing fabric in the vertical direction (lengthwise direction) is smaller than the expansion/contraction ratio of the reinforcing fabric in the horizontal direction (crosswise direction) even though the expansion/contraction ratio of the fabric of the no-show sock in the vertical direction (lengthwise direction) is larger than the expansion/contraction ratio of the fabric of the no-show sock in the horizontal direction (crosswise direction), the big toe portion or the second toe portion is tightened, which may cause a feeling of restlessness and deterioration in wearing comfort of the no-show sock. Therefore, to provide comfortable wearing comfort, the reinforcing fabric 230 may be set such that the expansion/contraction ratio in the vertical direction (lengthwise direction) is larger than the expansion/contraction ratio in the horizontal direction (crosswise direction) so that the fabric of the no-show sock and the fabric of the reinforcing fabric may have approximately uniform expansion/contraction ratios in the same direction.

The reinforcing fabric 230 may be made of the same material as the no-show sock 200 or made of a material different from and having higher durability than the material of the no-show sock.

Figure 13:
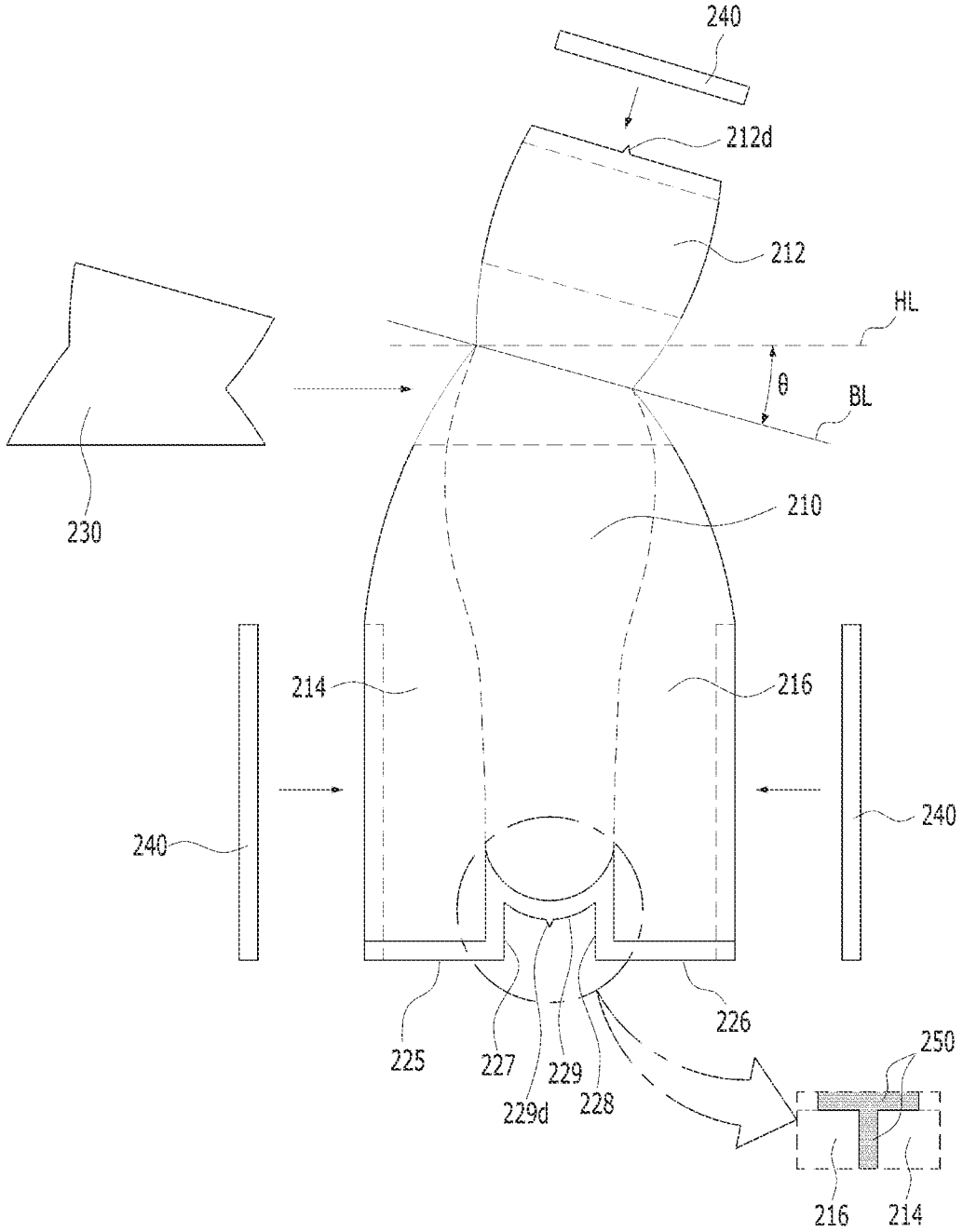
FIG. 13 is a view illustrating a state in which a reinforcing fabric, an elastic band, and a friction member are attached to the blank for manufacturing a no-show sock by using a fabric according to the second embodiment of the present invention.

In addition, as illustrated in FIG. 13, elastic bands 240 may be attached to the edge of the upper end of the front portion 212 of the no-show sock, the edge of the lower side of the first lateral portion 214, and the edge of the lower side of the second lateral portion 216, respectively. Because the elastic band 240 is attached, a contraction force is applied to the opening portion of the no-show sock, such that the opening portion of the no-show sock may be in stably close contact with the wearer's foot top.

In addition, in the no-show sock 200 according to the second embodiment of the present invention, a silicone friction member 250 may be attached to an outer portion of the overlapping portion between the fifth superimposed portion 225 of the first lateral portion 214 and the sixth superimposed portion 226 of the second lateral portion 216. In addition, the silicone friction member 250 may be attached to a portion of the edge of the first lateral portion 214 and a portion of the edge of the second lateral portion 216 that correspond to the heel. With this configuration, the "T"-shaped silicone friction member 250 is disposed on an inner portion of the no-show sock 200, which comes into contact with the heel, as illustrated in the right lower end of FIG. 13, such that the friction member 250 comes into contact with the wearer's heel in the horizontal and vertical directions. Therefore, the wearing stability of the no-show sock may be improved, and a frictional force between the no-show sock and the heel may be increased, which makes it possible to prevent the no-show sock from being pulled off when the user takes off the shoe.

Next, a method of manufacturing the no-show sock 200 by using a fabric according to the second embodiment of the present invention will be described. In the description of the method of manufacturing the no-show sock 200, components and/or elements which are described above with the descriptions of the above-mentioned blank 2 and no-show sock 200 will be omitted.

First, the fabric made of a material having elasticity is cut into a form of the blank 2 illustrated in FIG. 11 (S210).

In this case, a plurality of sheets of blanks 2 are manufactured by stacking a plurality of sheets (e.g., about 100 sheets) of fabrics each having a predetermined horizontal× vertical dimension (e.g., a horizontal length of about 150 cm×a vertical length of about 300 cm), positioning a marker (not illustrated), which is manufactured to have the same shape as the blank 2, on the upper surface of the fabrics, and cutting the plurality of sheets of fabrics into the shape identical to the shape of the marker by using a cutting machine or the like (S210).

The blank 2 illustrated in FIG. 11 includes: the bottom portion 210 configured to define the bottom of the no-show sock made by a series of fabrics connected integrally, and having the contour corresponding to the sole; the front portion 212 having the contour corresponding to the toes and the front foot top; and the first and second lateral portions 214 and 216 configured to surround the lateral foot sides and the heel. The front portion 212 is connected to the upper end of the bottom portion 210. The boundary line BL on which the bottom portion 210 and the front portion 212 are connected has a predetermined inclination angle θ with respect to the horizontal line HL perpendicular to the central axis CL of the bottom portion 210. In this case, the inclination angle θ may be about 5° to 30°.

Next, the front portion 212 of the blank 2 is folded along the boundary line BL between the front portion 212 and the bottom portion 210 relative to the bottom portion 210 (S220).

Next, the two opposite edges 212*a* and 212*b* of the front portion 212 are respectively aligned and coincident with the upper edge 214*a* of the first lateral portion 214 and the upper edge 216*b* of the second lateral portion 216 and seam-sealed together (S230). In this case, a hot-melt process in the related art may be performed instead of the seam sealing process. As illustrated in FIG. 12B, the bar tack 260 may be formed to densely sew the end portions where the two opposite edges 212*a* and 212*b* of the front portion 212 are seam-sealed with the upper edge 214*a* of the first lateral portion 214 and the upper edge 216*b* of the second lateral portion 216 because stress is concentrated on the end portions. The bar tack 260 may have the same color as the no-show sock 200 or have a color different from the color of the no-show sock 200.

Next, the fifth superimposed portion 225 at the lower end of the first lateral portion 214 and the sixth superimposed portion 226 at the lower end of the second lateral portion 216 overlap each other and are sewn in one or more lines (S240).

Next, the ninth superimposed portion 229 at the lower end of the bottom portion 210 may overlap the seventh superimposed portion 227 inside the first lateral portion 214 and the eighth superimposed portion 228 inside the second lateral portion 216 to be sewn in one or more lines (S250).

In the method of manufacturing the no-show sock 200 according to the modified example of the second embodiment of the present invention, the plurality of sheets of blanks 200 are cut by the process S210, and then the following processes may be selectively performed before the process S220 is performed.

The elastic bands 240 may be temporarily joined to the edge of the upper end of the front portion 212 of the blank 2, the edge of the first lateral portion 214, and the edge of the second lateral portion 216, respectively (an initial operation is performed), or the reinforcing fabric 230 having a predetermined vertical height is temporarily joined along the boundary line BL between the bottom portion 210 and the front portion 212, and then a thermal pressing operation (a pressing operation performed while applying heat) may be performed on the temporarily joined portion of the elastic band 240 and/or the temporarily joined portion of the reinforcing fabric 230 (S270). In this case, the reinforcing fabric 230 may be arranged so that the expansion/contraction ratio in the vertical direction (lengthwise direction) is larger than the expansion/contraction ratio in the horizontal direction (crosswise direction). In addition, the "T"-shaped silicone friction member 250 may be attached to the portion of the no-show sock that corresponds to the heel (S280). In this case, silicone may be applied to the portion of the no-show sock corresponding to the heel, or the portion of the no-show sock corresponding to the heel may be applied or coated with silicone, instead of attaching the silicone friction member 250.

The sock manufactured by the method of manufacturing the no-show sock 200 according to the second embodiment of the present invention described above is turned inside out and worn so that the seam sealing portion, the sewn line, the reinforcing fabric, the elastic band, the silicone friction member, and the like are disposed inside the no-show sock.

The present invention, which has been described above, is not limited by the aforementioned embodiments and the accompanying drawings, and it will be obvious to those skilled in the art to which the present invention pertains that various substitutions, modifications and alterations may be made without departing from the technical spirit of the present invention.

EXPLANATION OF REFERENCE NUMERALS

1, 2: blank
10, 210: bottom portion
12, 212: front portion
14, 214: first lateral portion
16, 216: second lateral portion
21: first superimposed portion
21A: front surface of the first superimposed portion
21B: rear surface of the first superimposed portion
22: second superimposed portion
22A: front surface of the second superimposed portion
22B: rear surface of the second superimposed portion
23: third superimposed portion
23A: front surface of the third superimposed portion
23B: rear surface of the third superimposed portion
24: fourth superimposed portion
24A: front surface of the fourth superimposed portion
24B: rear surface of the fourth superimposed portion
25, 225: fifth superimposed portion
26, 226: sixth superimposed portion
27, 227: seventh superimposed portion
28, 228: eighth superimposed portion
29, 229: ninth superimposed portion
30, 230: reinforcing fabric
31: first cutting line
32: second cutting line
40, 240: elastic band
50, 250: friction member
100, 200: no-show sock
BL, BL1, BL2: boundary line
CL: central axis
HL: horizontal line
θ: inclination angle

What is claimed is:

1. A blank (2) for manufacturing a no-show sock by using a fabric, the blank (2) comprising:

a bottom portion (210) having a contour configured to correspond to a sole and configured to define a bottom of the no-show sock;

a front portion (212) having a contour configured to correspond to toes and a front foot top; and first and second lateral portions (214, 216) configured to surround lateral foot sides and a heel, the bottom portion (210), the front portion (212), and the first and second lateral portions (214, 216) are made by the fabric and connected integrally, wherein the front portion (212) is connected to an upper end of the bottom portion (210), and wherein a boundary line BL on which the bottom portion (210) and the front portion (212) are connected has a predetermined inclination angle θ with respect to a horizontal line HL perpendicular to a central axis CL of the bottom portion (210), wherein first and second lateral portions (214, 216) are connected to two opposite edges (210*a*, 210*b*) of the bottom portion (210), respectively, a lower end of the bottom portion (210) has a contour curved and protruding outward configured to correspond to the heel, and a ninth superimposed portion (229) is formed at a lower end of the bottom portion (210), wherein a fifth superimposed portion (225) is formed at a lower end of the first lateral portion (214), and a seventh superimposed portion (227) is formed on an inner edge of the first lateral portion (214), wherein a sixth superimposed portion (226) is formed at a lower end of the second lateral portion (216), and an eighth superimposed portion (228) is formed on an inner edge of the second lateral portion (216), wherein two opposite edges (212*a*, 212*b*) of the front portion have contours respectively corresponding to an upper edge (214*a*) of the first lateral portion (214) and an upper edge (216*b*) of the second lateral portion (216), wherein when the front portion (212) is folded along the boundary line BL relative to the bottom portion (210), the two opposite edges (212*a*, 212*b*) of the front portion are aligned with the upper edge (214*a*) of the first lateral portion (214) and the upper edge (216*b*) of the second lateral portion (216), respectively and seam-sealed together, wherein the fifth superimposed portion (225) at the lower end of the first lateral portion (214) and the sixth superimposed portion (226) at the lower end of the second lateral portion (216) overlap each other and are sewn together, wherein the ninth superimposed portion (229) at the lower end of the bottom portion (210) overlaps with the seventh superimposed portion (227) on an inner edge of the first lateral portion (214) and the eighth superimposed portion (228) on an inner edge of the second lateral portion (216) and is sewn together with them, and wherein a protrusion (229*d*) protruding outward along the central axis CL of the bottom portion (210) is formed at a center of the ninth superimposed portion (229) at the lower end of the bottom portion (210).

2. The blank of claim 1, wherein the inclination angle θ of the boundary line BL on which the bottom portion (210) and the front portion (212) are connected with respect to the horizontal line HL perpendicular to the central axis CL of the bottom portion (210) is about 5° to 30°.

3. A no-show sock (200) comprising:

a bottom portion (210) having a contour configured to correspond to a sole and configured to define a bottom of the no-show sock;

a front portion (212) having a contour configured to correspond to toes and a front foot top; and first and second lateral portions (214, 216) configured to surround lateral foot sides and a heel, the bottom portion (210), the front portion (212), and the first and second lateral portions (214, 216) are made by a fabric and connected integrally, wherein the front portion (212) is connected to an upper end of the bottom portion (210), wherein a boundary line BL on which the bottom portion (210) and the front portion (212) are connected has a predetermined inclination angle θ with respect to a horizontal line HL perpendicular to a central axis CL of the bottom portion (210), wherein the first and second lateral portions (214, 216) are connected to two opposite edges (210*a*, 210*b*) of the bottom portion (210), respectively, a lower end of the bottom portion (210) has a contour curved and protruding outward configured to correspond to the heel, and a ninth superimposed portion (229) is formed at a lower end of the bottom portion (210), wherein a fifth superimposed portion (225) is formed at a lower end of the first lateral portion (214), and a seventh superimposed portion (227) is formed on an inner edge of the first lateral portion (214), wherein a sixth superimposed portion (226) is formed at a lower end of the second lateral portion (216), and an eighth superimposed portion (228) is formed on an inner edge of the second lateral portion (216), wherein two opposite edges (212*a*, 212*b*) of the front portion have contours corresponding to an upper edge (214*a*) of the first lateral portion (214) and an upper edge (216*b*) of the second lateral portion (216), respectively, wherein when the front portion (212) is folded along the boundary line BL relative to the bottom portion (210), the two opposite edges (212*a*, 212*b*) of the front portion are aligned with the upper edge (214*a*) of the first lateral portion (214) and the upper edge (216*b*) of the second lateral portion (216), respectively and seam-sealed together, wherein the fifth superimposed portion (225) at the lower end of the first lateral portion (214) and the sixth superimposed portion (226) at the lower end of the second lateral portion (216) overlap each other and are sewn together, wherein the ninth superimposed portion (229) at the lower end of the bottom portion (210) overlaps with the seventh superimposed portion (227) on an inner edge of the first lateral portion (214) and the eighth superimposed portion (228) on an inner edge of the second lateral portion (216) and is sewn together with them, and wherein a reinforcing fabric (230) is attached along the boundary line BL between the bottom portion (210) and the front portion (212), the reinforcing fabric comprising fiber arranged in a vertical direction and fiber arranged in a horizontal direction, and an expansion/contraction ratio of the fiber arranged in the vertical direction is larger than an expansion/contraction ratio of the fiber arranged in the horizontal direction in the reinforcing fabric (230).

4. The no-show sock of claim 3, wherein the fabric used to manufacture the bottom portion (210), the front portion (212), and the first and second lateral portions (214, 216) is woven by crossing a weft and a warp, both the weft and the warp having elasticity.

5. The no-show sock of claim 3, wherein the inclination angle θ of the boundary line BL on which the bottom portion (210) and the front portion (212) are connected with respect to the horizontal line HL perpendicular to the central axis CL of the bottom portion (210) is about 5° to 30°.

* * * * *